US010693221B2

(12) United States Patent
Frye et al.

(10) Patent No.: US 10,693,221 B2
(45) Date of Patent: Jun. 23, 2020

(54) MODULAR PHASED ARRAY

(71) Applicant: Blue Danube Systems, Inc., Warren, NJ (US)

(72) Inventors: Robert C. Frye, Piscataway, NJ (US); Peter Kiss, Basking Ridge, NJ (US); Josef Ocenasek, Whippany, NJ (US)

(73) Assignee: Blue Danube Systems, Inc., Warren, NJ (US)

( * ) Notice: Subject to any disclaimer, the term of this patent is extended or adjusted under 35 U.S.C. 154(b) by 392 days.

(21) Appl. No.: 15/215,987

(22) Filed: Jul. 21, 2016

(65) Prior Publication Data

US 2017/0025749 A1 Jan. 26, 2017

Related U.S. Application Data

(60) Provisional application No. 62/195,456, filed on Jul. 22, 2015.

(51) Int. Cl.
*H01Q 1/38* (2006.01)
*H01Q 21/00* (2006.01)
(Continued)

(52) U.S. Cl.
CPC ..... *H01Q 1/38* (2013.01); *H01Q 1/48* (2013.01); *H01Q 21/0025* (2013.01);
(Continued)

(58) Field of Classification Search
CPC . H01R 12/73; H01Q 1/38; H01Q 1/48; H01Q 21/0025; H01Q 21/062; H01Q 21/065; H01Q 21/08; H01Q 21/22; H01Q 3/36; H01Q 1/02; H01Q 1/2291; H01Q 1/246; H01Q 1/523; H01Q 1/526; H01Q 3/26; H01Q 3/30; H01Q 21/0006; H01Q 21/0075; H01Q 21/0093; H01Q 21/067; H01Q 21/28; H01Q 23/00; H01Q 12/73;
(Continued)

(56) References Cited

U.S. PATENT DOCUMENTS 3,549,949 A 12/1970 Granberry
5,099,254 A 3/1992 Tsukii et al.
(Continued)

FOREIGN PATENT DOCUMENTS

EP 2 549 589 1/2013

*Primary Examiner* — Yuwen Pan
*Assistant Examiner* — Paul P Tran
(74) *Attorney, Agent, or Firm* — Occhiuti & Rohlicek LLP

(57) ABSTRACT

A removable module for a phased array, the module including: a circuit board having a ground plane formed on one side of the circuit board; an antenna mounted on and extending away from a topside of the circuit board; circuitry on a backside of the circuit board, the circuitry including an RF front end circuit coupled to the antenna; and a group of one or more first connecters mounted on the backside of the circuit board, the first connectors for physically and electrically connecting and disconnecting the module from a master board through a corresponding group of one or more matching second connectors on the master board, the first connectors on the module having electrically conductive lines for carrying an externally supplied LO signal for the RF front end circuit and an IF signal for or from the RF front end circuit.

23 Claims, 15 Drawing Sheets

(51) Int. Cl.

| | |
|---|---|
| ***H01Q 21/06*** | (2006.01) |
| ***H01Q 1/48*** | (2006.01) |
| ***H01Q 21/22*** | (2006.01) |
| ***H01R 12/73*** | (2011.01) |
| *H01Q 21/08* | (2006.01) |
| *H01Q 3/36* | (2006.01) |

(52) U.S. Cl.
CPC ..... *H01Q 21/062* (2013.01); *H01Q 21/22* (2013.01); *H01R 12/73* (2013.01); *H01Q 3/36* (2013.01); *H01Q 21/065* (2013.01); *H01Q 21/08* (2013.01)

(58) Field of Classification Search
CPC .. H04B 1/0007; H04B 1/0067; H04B 1/0483; H04B 1/40; H04B 7/0404; H04B 1/034; H04B 1/0343; H04B 1/38; H04B 7/0682; H01L 23/055; H01L 23/492; H01L 23/49822; H01L 23/49894; H01L 23/552; H01L 23/66
See application file for complete search history.

(56) References Cited

U.S. PATENT DOCUMENTS 6,362,780 B1 * 3/2002 Butz ..... H01Q 3/26 342/157
6,650,290 B1 * 11/2003 Chang ..... H01Q 3/26 342/368
7,511,666 B2 * 3/2009 Jacomb-Hood ..... H01Q 1/288 342/373
2003/0150641 A1 * 8/2003 Kinayman ..... H01L 23/055 174/255
2004/0252059 A1 * 12/2004 Zaghloul ..... H01Q 9/0414 343/700 MS
2007/0077967 A1 * 4/2007 Nicholls ..... H04B 1/18 455/561
2010/0073896 A1 * 3/2010 Tang ..... H04B 1/40 361/803
2010/0164783 A1 * 7/2010 Choudhury ..... H01Q 3/26 342/175
2010/0246130 A1 9/2010 Paquette et al.
2012/0050091 A1 * 3/2012 Inanni ..... G01S 13/931 342/107
2012/0142280 A1 * 6/2012 Banu ..... H04B 7/0682 455/69
2012/0162922 A1 6/2012 Cheyne et al.
2012/0258754 A1 10/2012 Banu et al.
2012/0309325 A1 12/2012 Carbone
2013/0070819 A1 * 3/2013 Zhao ..... H01Q 1/246 375/219
2014/0037034 A1 2/2014 Banu et al.
2015/0015453 A1 1/2015 Puzella et al.
2015/0087248 A1 * 3/2015 Yehezkely ..... H04B 1/0007 455/84
2015/0263424 A1 * 9/2015 Sanford ..... H01Q 3/46 342/371

* cited by examiner

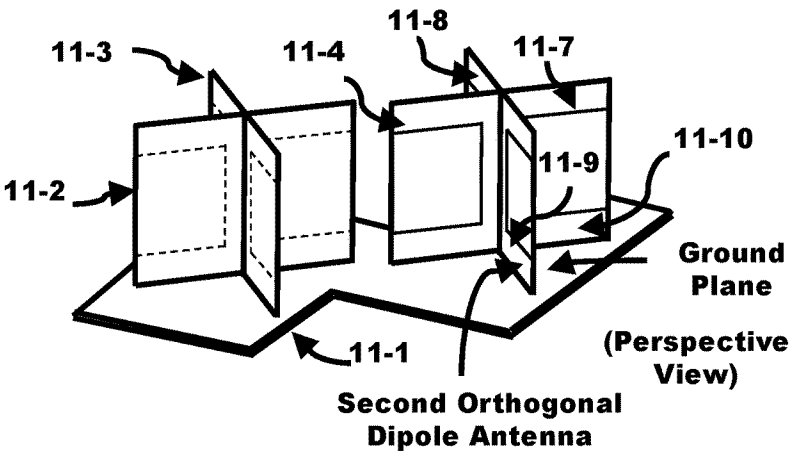
FIG. 11A
FIG. 11B
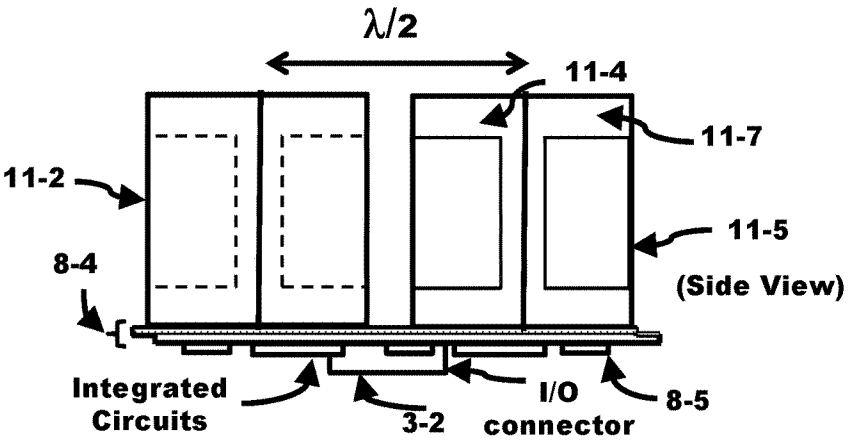
FIG. 11C

MODULAR PHASED ARRAY

CROSS REFERENCE TO RELATED APPLICATIONS

This application claims priority to U.S. Provisional Application No. 62/195,456, filed on Jul. 22, 2015, the contents of which are hereby incorporated by reference in its entirety.

BACKGROUND

Phased arrays create beamed radiation patterns in free space to allow the formation of selective communication channels. A phased array is formed by placing a plurality of antennas in a grid pattern on a planar surface where these antennas are typically spaced ½ of the wavelength of the radio frequency (RF) signal from one another. The phased array can generate radiation patterns in preferred directions by adjusting the phase and amplitude of the RF signals being applied to each of the antennas. The emitted wireless RF signals can be reinforced in particular directions and suppressed in other directions due to these adjustments. Similarly, phased arrays can be used to reinforce or select the reception of wireless RF signals from preferred directions of free space while canceling wireless RF signals arriving from other directions. The incoming RF signals, after being captured by the phased array, can be phase and amplitude adjusted and combined to select RF signals received from desired regions of free space and discard RF signals that were received from undesired regions of free space. The wireless beam is steered electronically to send and receive a communication channel, thereby eliminating the need to adjust the position or direction of the antennas mechanically.

A phased array requires the orchestration of the plurality of antennas forming the array to perform in unison. A corporate feed network provides the timing to the phased array by delivering identical copies of an RF signal to each of the plurality of antennas forming the phased array. A uniform placement of the plurality of antennas over a planar area defines the phased array as having a surface area that extends over several wavelengths of the carrier frequency of the RF signal in both of the X and Y directions. For example, a phased array with 100 antennas arranged in a square planar area would have edge dimension equal to 5 wavelengths of the RF carrier frequency in each direction.

The corporate feed network can be a passive or active tree network that extends its branches to the antennas of the phased array that cover this surface area. Networks that accomplish this form of distribution are known as a binary tree distribution (for linear array) and H-tree distribution (for planar array) networks. A binary tree can be a 1:N distribution network that is formed using a binary partitioning. A source signal is matched to an input/output (I/O) port of a transmission line. The end of the transmission line is split to two equal length transmission lines where certain impedance matching conditions must be met at the split. This junction comprising this split is called a power divider. Theoretically a power divider is lossless, reciprocal and matched at all three ports, but is difficult to construct. In practice, the power divider can be made lossy at the expense of maintaining the divider reciprocal and matched. The ends of the two equal length transmission lines are each split with power splitters' and transmission line segments. The process of splitting each added transmission line continues until the number of branch tips (I/O ports) of the passive tree equals N (a power of 2). The antennas can be coupled to the branch tips. Each of the N branch tips must be properly terminated.

Such a binary partitioned network insures that the summation of the lengths of the transmission lines coupling the I/O port of the first transmission line to each of the branch tips in a corporate feed network is equal in length. Thus, the flight time of a signal sourced at this I/O port along any of these paths to each of the plurality of branch tips would be the same. This theoretically eliminates any phase variation of that signal when multiple copies of the signal arrive at all of the branch tips. These are the signals used to orchestrate the plurality of antennas in unison. Once the RF signal arrives at every antenna from the network, the phase/amplitude of the RF signal is adjusted locally at each antenna to create the desired radiation pattern described earlier.

Since the power dividers are reciprocal, the corporate network can also be used to transfer signals from the antennas that are coupled to the branch tips and combine these signals at the I/O port of the first transmission line. Corporate feed networks are used to extract desired RF signals captured by the antennas of the phased array from different regions of free space; the phase/amplitude of the received RF signal is adjusted locally at each antenna to select a desired radiation pattern from free space.

Conventional phased arrays use corporate feed networks to transport RF signals to and from the antennas. The corporate feed network propagates all these high frequency components of the RF signal from a single source to all of the individual antennas of the phased array. Some of the frequency components of the RF signal will experience impedance mismatch at the power splitters causing reflections that leads to the distortion of the signal. The high frequency signal content of the RF signal suffers skin effect losses in the transmission lines, which can further degrade the quality of the RF signal. In order to operate at high frequencies, the transmission lines need to have high quality, low-dispersion properties. To minimize losses in this network and to insure that proper impedance matching occurs within this network is a challenge. A system to meet this challenge is costly since it requires all components of the system to have well-controlled impedances to minimize reflections at the splitters and to have low loss characteristics to prevent signal degradation.

It is understood that the distribution of the RF signal over the corporate feed network to and from a plurality of antennas is a difficult challenge due to the loss of signal and mismatch issues. Such a system incurs a higher cost of manufacturing to construct the circuit board and connectors in an attempt to reduce these concerns.

SUMMARY

In general, in one aspect, the invention features a removable module for a phased array. The module includes: a circuit board having a ground plane formed on one side of the circuit board; an antenna mounted on and extending away from a topside of the circuit board; circuitry on a backside of the circuit board, the circuitry including an RF (radio frequency) front end circuit coupled to the antenna; and a group of one or more first connecters mounted on the backside of the circuit board, the group of one or more first connectors for physically and electrically connecting the module to and disconnecting the module from a master board through a corresponding group of one or more matching second connectors on the master board, the group of one or more first connectors on the module having a plurality of electrically conductive lines for carrying an externally supplied LO (local oscillator) signal for the RF front end circuit on the module and for carrying an IF (intermediate frequency) signal for or from the RF front end circuit on the module.

Other embodiments include one or more of the following features. The RF front end circuit includes an up converter for mixing the IF signal and a signal derived from the LO signal to generate an RF signal that is delivered to the antenna and a down converter for mixing an RF signal received by the antenna with a signal derived from the LO signal to generate a received IF signal that is delivered to external circuitry through the one or more first connectors. The one or more first connectors is a single connector or, alternatively, a plurality of first connectors. The ground plane is located on the backside of the circuit board. The RF front end circuit includes phase control circuitry for adjusting the phase of the RF signal that is generated by the RF front end circuit. The plurality of conducting lines of the one or more first connectors are also for carrying externally supplied control signals for controlling the RF front end circuit. The plurality of conducting lines of the one or more first connectors are also for supplying power to the RF front end circuit from an external source. The removable module also includes a plurality of antennas each of which is mounted on and extends away from the topside of the circuit board, wherein the first-mentioned antenna is one of the plurality of antennas. The circuitry further includes a plurality of RF front end circuits each of which is coupled to a different one of the plurality of antennas, wherein the first-mentioned RF front end circuit is one of the plurality of RF front end circuits. The plurality of electrically conductive lines of the group of one or more first connectors are for carrying an externally supplied LO signal for each of the plurality of RF front end circuits on the module and for carrying an IF signal for or from each of the plurality of RF front end circuits on the module.

In general, in another aspect, the invention features a phased array including: a master board having a first network of signal transmission lines for distributing LO signals; a plurality of groups of one or more first connectors, the plurality of groups of one or more first connectors mounted on a top side of the master board, wherein each group of one or more first connectors is coupled to the first network of transmission lines; and a plurality of removable modules. Wherein each of the modules of the plurality of modules has one or more of the features described above.

Embodiments of this disclosure include methods and systems to construct a modular phased array using modules, each module having an RF front end for the distribution and aggregation of a plurality of incoming and outgoing intermediate frequency (IF) signals and an antenna element to wirelessly receive and transmit RF signals, the received RF signals down-converted into the incoming IF signals, the outgoing IF signals up-converted into the transmitted RF signals, a connector to transfer the incoming and outgoing IF signals on and off the module, respectively, and the connector transferring at least one local oscillator (LO) onto the module.

BRIEF DESCRIPTION OF THE DRAWINGS

FIG. 11A shows a top view of a module with two cross-pole antennas in accordance with the present disclosure.

FIG. 11B shows a perspective view of a module with two cross-pole antennas in accordance with the present disclosure.

FIG. 11C depicts a side view of a module with two cross-pole antennas in accordance with the present disclosure.

DETAILED DESCRIPTION

Figure 1A:
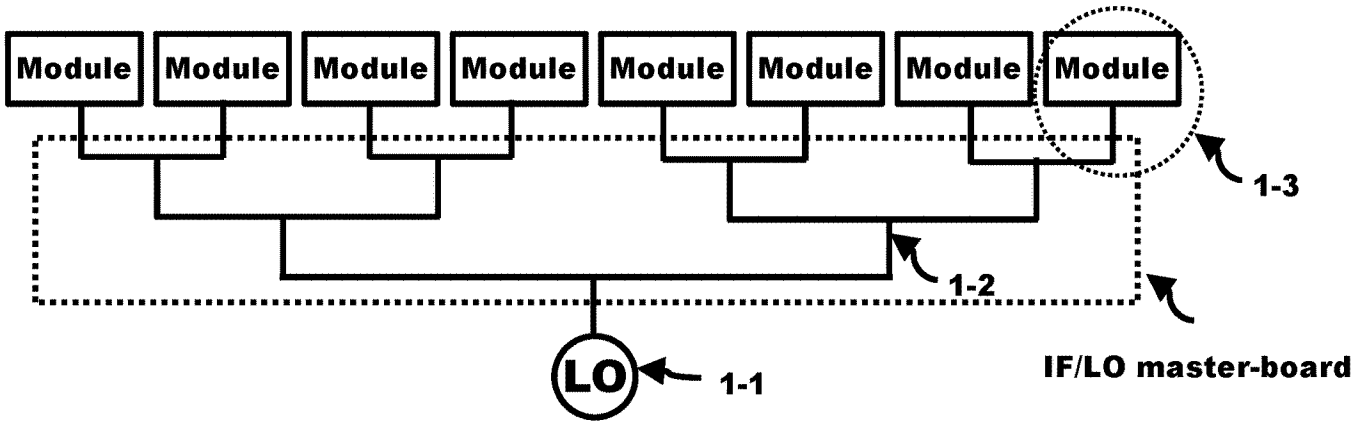
FIG. 1A illustrates a corporate feed formed on an IF/LO master-board that can be used to couple an LO to a plurality of modules coupled to the IF/LO master-board.

This disclosure presents methods and systems that eliminate the need to distribute RF signals with their high frequency content over a distribution network to and from all antennas of a modular phased array. Instead of distributing RF signals, the high frequency content RF signal is created or used locally and in the vicinity of its corresponding antenna within the modular phased array. This is accomplished by the distribution of at least one LO (local oscillator) signal to and at least one IF signal to and from all antennas of a modular phased array. The LO signal can be sourced from an analog oscillator, frequency synthesizer, or an external source. The LO signal provides a periodic, non-modulated, oscillating signal and is substantially free of any higher order frequency components. Two different networks are described to distribute the LO signal: a corporate feed network where the frequency of the LO signal is similar to the fundamental frequency of the RF signal; and a bidirectional signaling (BDS) network where the frequency of the distributed LO signal is approximately half of the fundamental frequency of the RF signal. The BDS networks can also be used to distribute modulated signals, if desired.

The RF signal that is transmitted by an antenna is created on the module by up-converting or mixing the locally available IF and LO signals together. Similarly, an incoming RF signal received by the antenna on the module is immediately transformed (down-converted) on the module into a locally generated IF signal by mixing it with a locally available LO signal. Localizing the down-conversion and the generation of RF signals near the antenna lends itself to a system that can be constructed in a modular fashion. The antenna and the circuitry necessary for up-conversion and down-conversion are localized on a module. The circuitry between the antenna and including one or more up and down converters, which performs the operations of up and down conversions, as is known in the art, is called the RF front end. Any phase shifters or variable gain amplifiers that are used to change a relative phase or amplitude of signals, respectively, within the RF front end are also considered part of the RF front end. In one embodiment, the RF front end includes at least one PA (power amplifier), at least one LNA (low noise amplifier), at least one Dup/SW (duplexer/switch), and a plurality of U/D (up-conversion/down-conversion) blocks. The U/D block typically includes the above-mentioned phase shifters and variable gain amplifiers. The one or more antennas mounted on the module are the only entry ports or exit ports for any RF signal found on the module. The RF signal that is up-converted on the module excites the local antenna and is transmitted into free space as a wireless RF signal. The RF signal that is down-converted on the module arrived from the antenna after being received as a wireless RF signal from free space. An I/O connector mounted on the board transfer LO and IF signals on or off the module. A plurality of these modules can be connected to a larger circuit board. The larger circuit board can form a portion or all of a modular phased array. The larger circuit board distributes the LO and IF signals to all of the modules through a connector on each of the modules. The LO and IF signals are used in the RF front end to perform the up and down conversions that are local to the one or more mounted antennas on the module.

The previous conventional approach of using a corporate feed network to distribute RF signals over the entire phased array are prone to signal losses and mismatch issues. These issues are reduced in the embodiments of the modular phased array since the RF signals are upconverted or down-converted locally on each module near their corresponding antenna. These advantages alleviate the previous constraint of the need for costly circuit boards and connectors, simplifying the over-all design and thereby reducing the cost of manufacturing the modular phased array. Furthermore, the modular phased array can be constructed from modular circuit board components that are coupled by connectors. These connectors do not require the same stringent electrical requirements as the costly connectors required in the corporate feed network since the connectors of the modules do not carry RF signals.

FIG. 1A illustrates a binary tree distribution network called a corporate feed network 1-2 which distributes a source signal, for example, an LO signal 1-1, to a plurality of modules 1-3. The purpose of the corporate feed network is to distribute the source signal to each and every module 1-3 such that the LO signal arrives at each module 1-3 with the same phase. The source signal can also be other types of signals such as an IF signal or an RF signal. However, IF signals do not typically need to be distributed with a corporate feed network if the symbol duration of the IF signal is small compared to the propagation delays throughout the system. The phase of the LO signal with respect to the other LO signals that arrive at each module is used to set a reference point to perform up and down conversion operations on that module. The corporate feed distribution network can be formed on an IF/LO master-board that routes these source signals, such as the LO or IF signals, using electrical conductive traces in a circuit board. These electrical traces that are used to distribute the signal form transmission lines. If not stated explicitly, all distribution networks are formed with transmission lines and these transmission lines require proper termination in order to prevent signal reflections. The circuit board also provides physical support for the modules that are attached to the IF/LO master-board.

Figure 1B:
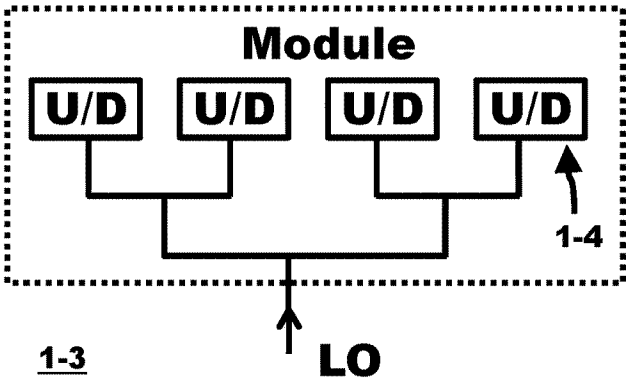
FIG. 1B depicts the corporate feed on each module of FIG. 1A to couple the LO signal to each up/down (U/D) converter.

As illustrated in FIG. 1B, each individual module 1-3 extends the corporate feed network into the module. If the routing on all modules is substantially the same, the phase of the LO signal arriving at all U/D blocks 1-4 in the system would be essentially identical. In addition, a similar network can be used to distribute transmitted IF signals (not illustrated) to each U/D block of all modules.

Figure 2A:
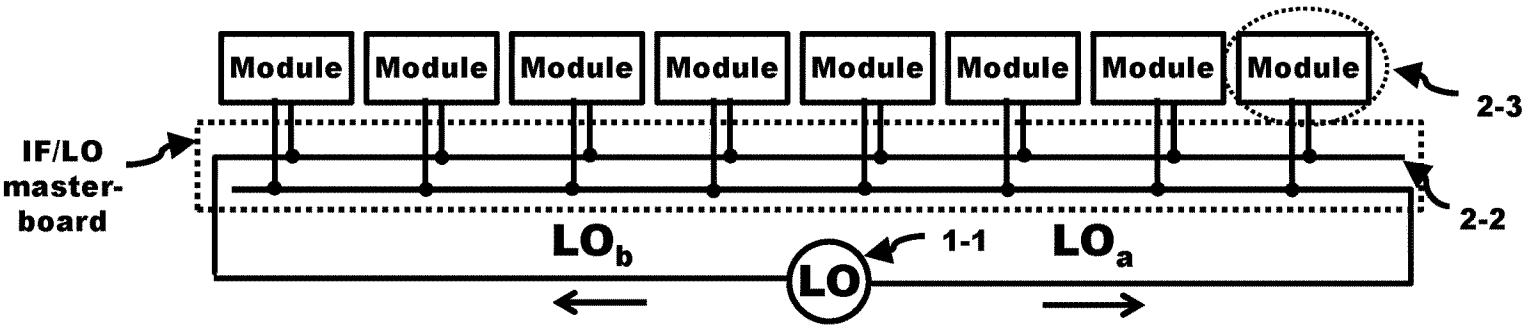
FIG. 2A shows a BDS network formed on an IF/LO master-board to distribute an LO signal to the plurality of modules in accordance with the present disclosure.

FIG. 2A illustrates a bidirectional signaling (BDS) network 2-2 which distributes a source signal, for example, an LO signal 1-1, to a plurality of modules 2-3 using a substantially different approach when compared to the corporate feed network. The BDS network reduces the overall transmission line length and signal loss between the source and destination when compared to the corporate feed network since the BDS is a serial link distribution. The BDS distribution network distributes two source signals $LO_a$ and $LO_b$ to each module 2-3, these two LO signals are combined to generate a BDS LO in precise phase synchronization on all modules. The BDS network is formed on the IF/LO master-board which routes two identical source signals in opposite directions using the electrical traces formed in a circuit board. For a detailed description of BDS, see Mihai Banu, and Vladimir Prodanov "Method and System for Multi-point Signal Generation with Phase Synchronized Local carriers" U.S. Pat. Pub. No. 2014/0037034, published Feb. 6, 2014, the contents of which are incorporated herein by reference in their entirety. The BDS LO signal is used to perform up and down conversion operations on that module. The circuit board also provides physical support for the modules that are attached to the IF/LO master-board.

Figure 2B:
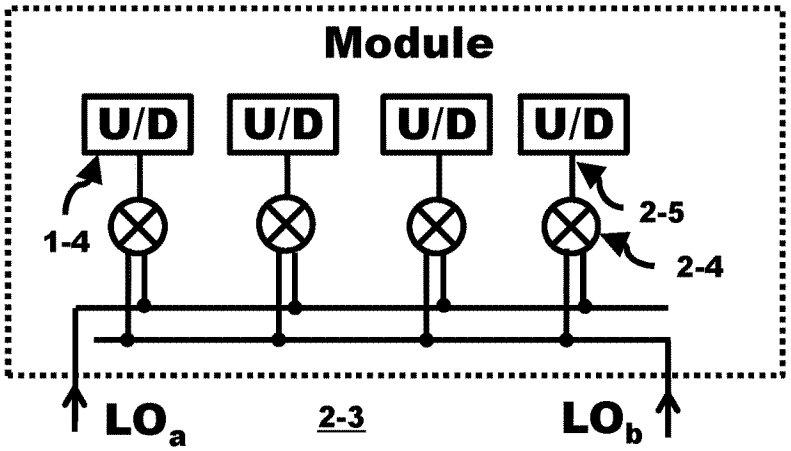
FIG. 2B depicts a BDS network formed on the module to distribute an LO signal to the plurality of U/D blocks in accordance with the present disclosure.

As illustrated in FIG. 2B, each individual module 2-3 can extend the BDS network into the module itself. The frequency signals $LO_a$ and $LO_b$ provided by the single source 1-1 (or separate LO sources, if desired) are coupled into the module from the IF/LO master-board and routed in opposite directions using the electrical traces formed in the circuit board of the module. These two signals arrive at each and every multiplier 2-4 and are multiplied together by the multipliers 2-4 to generate BDS LO signals 2-5. The BDS LO signal is twice the frequency of either of $LO_a$ or $LO_b$. The phases of the BDS LO signals that arrive at the U/D blocks 1-4 within the modules are substantially identical or synchronized with each other.

Figure 3:
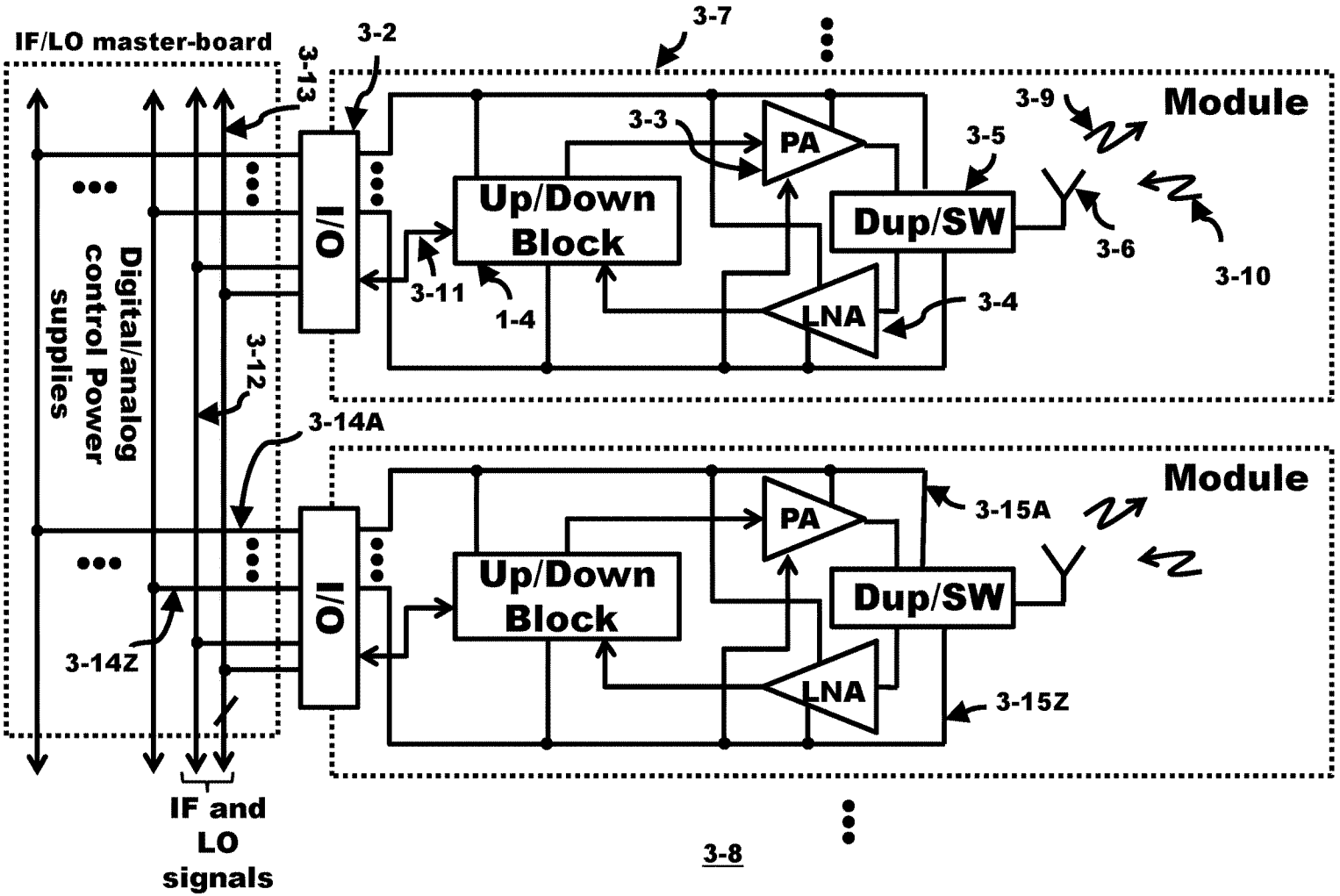
FIG. 3 presents an IF/LO master-board coupling LO and IF signals to a plurality of modules through an I/O connector where each module up/down converters a single IF in accordance with the present disclosure.

FIG. 3 illustrates a portion of a modular phased array antenna system 3-8, where two of a plurality of module circuit boards (or modules) 3-7 are illustrated comprising circuit blocks and coupling to an IF/LO master-board via an I/O connector 3-2. The I/O connector provides electrical continuity of signals transferred between the IF/LO master-board and the module and provides physical support of the module to the IF/LO master-board. A plurality of modules are connected to the IF/LO master-board to construct a modular phased array system. The signals are routed on the master-board and on the circuit boards with transmission lines that require proper termination to prevent signal reflections.

The I/O connector 3-2 carries the IF and LO signals (3-12 and 3-13) from the IF/LO master-board through the I/O connector. These signals are coupled to the inputs 3-11 of the U/D block 1-4. The I/O connector 3-2 also carries digital/analog control signals, power supplies, reference voltages, and ground supplies (3-14A through 3-14Z) between the IF/LO master-board and the module 3-7. These signals, supplies, and voltages are routed on the circuit board of the module (3-15A through 3-15Z) and are distributed and connected to the various circuit blocks to provide the power/ground, voltages and control signals to the corresponding circuit components within these blocks The module 3-7 includes an antenna 3-6, an U/D block 1-4, a power amplifier (PA) 3-3, a low noise amplifier (LNA) 3-4, and a duplexer or switch 3-5 which, in part, form an RF front end. The RF front end generates and/or uses several signal components: LO signals, IF signals and RF signals in conjunction with the listed electrical components to perform at least two functions. One function is to up-convert an outgoing IF signal using an LO signal to generate an RF signal that is to be transmitted; the other function is to down-convert an incoming RF signal that is received at the antenna using an LO signal to generate an incoming IF signal. The RF signal is either generated or consumed on the module in the respective up-conversion and down-conversion processes. The antenna connected to the module is the only I/O port that receives or transmits these RF signals. The antenna is an interface to free space which wirelessly transmits or receives these RF signals.

A signal traveling from an IF/LO master-board towards the antenna is in an outgoing direction. The module 3-7 receives the outgoing IF signal and LO signal from the IF/LO master-board through the I/O connector 3-2 and couples this outgoing IF signal and LO signal to the inputs 3-11 of the U/D block 1-4. The outgoing IF and LO signals are presented to the mixer within the U/D block. The U/D block up-converts the outgoing IF signal with the LO signal to create an RF signal directly on the module in an outgoing signal flow direction. The RF signal is applied to an input of the PA 3-3. The PA amplifies the RF signal which is then coupled through the Dup/SW 3-5 to the antenna 3-6. The antenna generates a wireless RF signal 3-9 that propagates into free space.

The distribution network that deliver the LO and outgoing IF signals to each module insures that the phase relation between the LO signal and outgoing IF signal is known and ideally the same for all modules as these signals enter the module 3-7. However, the wireless signal 3-9 transmitted from the module needs to be phase and/or amplitude adjusted with respect to all other wireless signals being transmitted from all other modules. This allows the combined RF signal in free space to add constructively or destructively together and place the combined RF wireless power intensity beam of the all transmitted signals into a selected volume element of free space. The phase and/or amplitude of the LO signal, outgoing IF signal, or up-converted RF signal at each U/D block is carefully controlled to insure that the up-converted signal is related properly to the remaining up-converted signals on all other modules.

At least one phase adjustment circuit (a phase shifter) is used to adjust lead or lag the phase angle of either one of the LO signal or the RF signal. The phase shifters function to shift the phase of the signal passing through it. The shift in the phase is controlled with either analog or digital control signals. The described embodiment uses digital control signals to adjust the phase shifters. In addition, at least one amplitude adjustment circuit (a variable gain amplifier) controlled by the analog or digital control signal may be used to modify the amplitude of at least one of the outgoing IF signal, the LO signal, or the RF signal. The control of the amplitude or phase adjustments can range from full, to partial, or to zero control. The digital control signals are bussed within the IF/LO master-board to the modules where they are provided to the phase shifters and variable gain amplifiers in the up/down converters via the connectors 3-2. These digital or analog control signals are generated by one or more processors in the digital front end (DFE) (see FIG. 14) and can include multiple interacting machines or computers. A computer-readable medium is encoded with a computer program, so that execution of that program by one or more processors performs one or more of the methods of phase and amplitude adjustment.

A received RF signal traveling from the antenna towards the IF/LO master-board is in an incoming direction. For an incoming signal, the antenna 3-6 receive at least one incoming RF wireless signal 3-10 from free space, couples the incoming RF signal through the duplexer or switch 3-5 to the low noise amplifier (LNA) 3-4. The LNA applies the amplified incoming RF signal to the U/D block which down-converts the incoming RF signal into an incoming IF signal. The down-converted IF signal is transferred through the I/O connector 3-2 to the IF/LO master-board. The module may further includes: RF filters, amplitude and phase adjustment circuits, amplifiers, phase lock loops (PLLs), data converters, digital circuits, and frequency synthesizers, none of which are illustrated so as to simplify the diagram.

The phase relation between the LO and the incoming RF signal is important in the down conversion of the incoming RF signal and needs to be carefully controlled. At least one phase adjustment circuit controlled by an analog or digital control signal is used to adjust the phase angle of at least one of the LO signal or the incoming RF signal. At least one amplitude adjustment circuit controlled by another analog or digital control signal is used to modify the amplitude of any one of the down-converted IF signal, the LO signal, or the incoming RF signal. The control of the amplitude or phase adjustments can include the full, partial, or zero control. For further details of the functionality of phase and amplitude adjustments, see "Low Cost, Active Antenna Arrays" U.S. Pat. Pub. No. 2012/0142280, published Jun. 7, 2012, incorporated herein by reference in its entirety. These digital or analog control signals are generated by one or more processors or multiple interacting machines or computers. A computer-readable medium is encoded with a computer program, so that the program when executed by one or more processors performs one or more of the methods of phase and amplitude adjustment.

The LO signal, the IF signal, and the RF signal can be single-ended or differential signals. A differential signal is made up of a first signal and a second signal where the second signal is a complement of the first signal.

The duplexer or switch 3-5 is used to control the capacity of the outgoing and incoming signals. The duplexer can be used in frequency division duplexing (FDD) systems to establish full duplex communication using different frequencies bands for the two different flow directions. The switch can be used in time division duplexing (TDD) systems to adjust the capacity of outgoing or incoming signal flow by allotting more time to one signal flow direction against the time of the second opposite signal flow direction.

In a modular phased array, all of modules up-convert their corresponding outgoing IF signal obtained from the IF/LO master-board and introduce the appropriate phasing and amplitude so that the RF wireless signals 3-9 from all of the antennas in the modular phased array superimpose and add constructively or destructively to place the combined RF wireless power intensity beam of the transmitted signal into a selected volume element of free space. Similarly, all of the modules down-convert the corresponding incoming RF signal obtained from the antenna and introduce the appropriate phasing and amplitude so that all the down-converted IF signals superimpose and add constructively or destructively to extract information that was received from a selected volume element of free space. For a further description of steered beams, see "Techniques for Achieving High Average Spectrum Efficiency in a Wireless System" U.S. Pat. Pub. No. 2012/0258754, published Oct. 11, 2012, incorporated herein by reference in its entirety.

The I/O connector 3-2, besides transferring the IF signals and LO signals between the module and IF/LO master-board, also provides the module with digital/analog control signals, power, and ground supplies sourced from the IF/LO master-board. If not stated explicitly, all modules include RF filters, amplitude and phase adjustment circuits, amplifiers, phase lock loops (PLLs), data converters, digital circuits, and frequency synthesizers to perform the above-mentioned operations, none of which are illustrated so as to simplify the diagram.

Some or all of the claimed electrical functionally can be implemented by discrete components mounted on a circuit board, by a combination of integrated circuits, an FPGA, or by an ASIC. Some or all of the claimed electrical functionally can be implemented with the aid of one or more processors that can include multiple interacting machines or computers. A computer-readable medium can be encoded with a computer program, so that execution of that program by one or more computers causes the one or more computers to perform one or more of the methods disclosed above.

The LO signal transferred from the IF/LO master-board through the I/O connector can be applied to the mixer within the U/D block by using a corporate feed network to distribute the LO signal. However, if the BDS scheme is used, an additional multiplier 2-4 (see FIG. 2B) is required to generate a BDS LO. Two of the distributed LO signals from the IF/LO master-board are multiplied together to create the BDS LO. If not stated explicitly, all modules can be connected to an IF/LO master-board that supports the corporate feed network, the BDS network, or a combination of both types of these networks.

Figure 4:
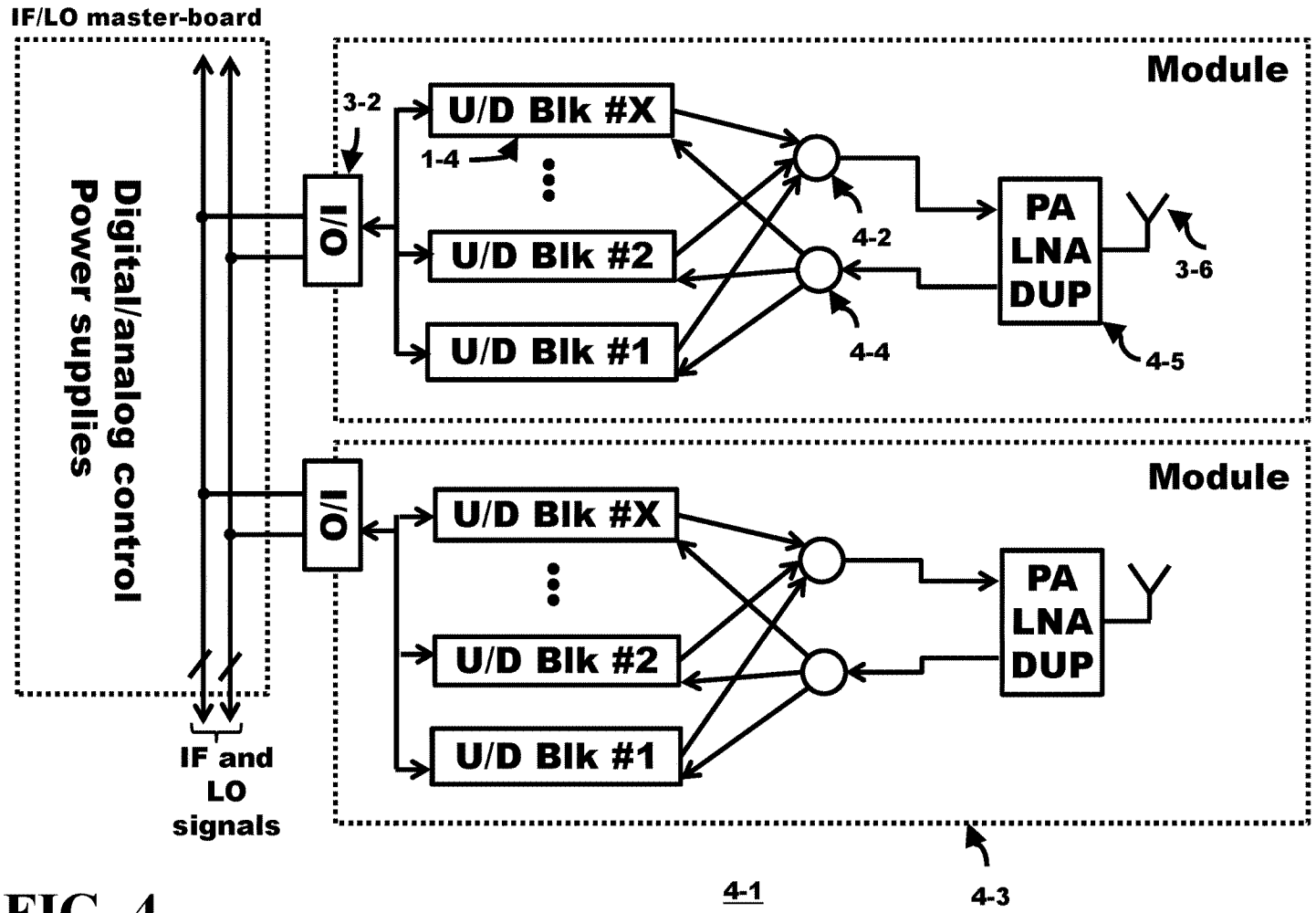
FIG. 4 illustrates an IF/LO master-board coupling LO and IF signals to a plurality of modules through an I/O connector where each module up/down converters a plurality of IF's in accordance with the present disclosure.

FIG. 4 presents another embodiment of a portion of a sub array antenna system 4-1, a module 4-3 is attached through its I/O connector 3-2 to at least one IF/LO master-board. The IF/LO master-board provides via the I/O connector at least one LO signal and one IF signal to each U/D block on every module. The distribution of the LO signal on the IF/LO master-board and module uses a network formed from at least one of the corporate feed network or the BDS network. These types of LO networks insure that the LO signals arriving at the U/D blocks are synchronized with each other. The module includes at least one antenna 3-6 and a plurality of U/D blocks 1-4. The phase of the LO signal or up-converted RF signal and/or the amplitude of the LO signal, outgoing IF signal, or up-converted RF signal is carefully controlled at each U/D block to insure that the up-converted signal is related properly to the remaining up-converted signals on all other modules. Each one of the plurality up-converters within the U/D block mixes a corresponding IF signal with the LO signal to create an outgoing RF signal. Each of the plurality of outgoing RF signals is combined at a combiner 4-2 into a single composite outgoing RF signal. The single composite outgoing RF signal is coupled to the antenna via the block 4-5 which represents the PA 3-3, LNA 3-4, and the duplexer or switch 3-5 presented in FIG. 3. The antenna 3-6 transmits the composite outgoing RF wireless signal into free space. Each component of the plurality of outgoing RF signal within the composite outgoing RF wireless signal can behave independently of the others. The same RF wireless component from all other modules superimpose and add constructively or destructively to place that component of the RF signal wireless power intensity beam of the transmitted signal into a selected volume element of free space. Similarly, the next RF wireless component within the composite outgoing RF wireless signal from all modules superimpose and add constructively or destructively to place that next component of the RF signal wireless power intensity beam of the transmitted signal into another selected volume element of free space. The plurality of up-converters can each service a plurality of users. That is, each IF signal can carry the communication signals of a plurality of users.

In the incoming signal flow direction, the antenna 3-6 receives at least one composite incoming RF wireless signal received from free space. The signal is amplified by the LNA in 4-5 and presented to the distributor 4-4 which applies the incoming RF signal to a plurality of U/D blocks. The plurality of U/D blocks down-converts the composite incoming RF signal with the LO signal, each is appropriately adjusted in phase or amplitude, into a corresponding plurality of incoming IF signals, each incoming IF signal generated by one of the plurality of U/D blocks. Each of the plurality of incoming IF signals, which can also be amplitude adjusted by the analog or digital control signals, is transferred from the module to the IF/LO master-board by the I/O connector 3-2. Once the IF signals are on the IF/LO master-board, the corresponding IF signal from each of the modules is sent to the DFE. The I/O connector also provides the module with digital/analog control signals, power, and ground supplies sourced from the IF/LO master-board. If not stated explicitly, all modules perform the function of phase and/or amplitude adjustments of at least one of the LO signal, IF signal, or RF signal using the analog or digital control signals as mentioned above.

The module 4-3 further includes: RF filters, amplitude and phase adjustment circuits, amplifiers, phase lock loops (PLLs), frequency synthesizers, PA's, LNA's, and a duplexer or a switch. These modules are coupled to an IF/LO master-board and used to control the direction and intensity of a plurality of emitted RF signals or extract information from a plurality of received RF signals that originated from different volume elements of free space. The claimed functionality is achieved with an absence of RF signals being transferred through the I/O connector which couples the module to the IF/LO master-board.

Figure 5:
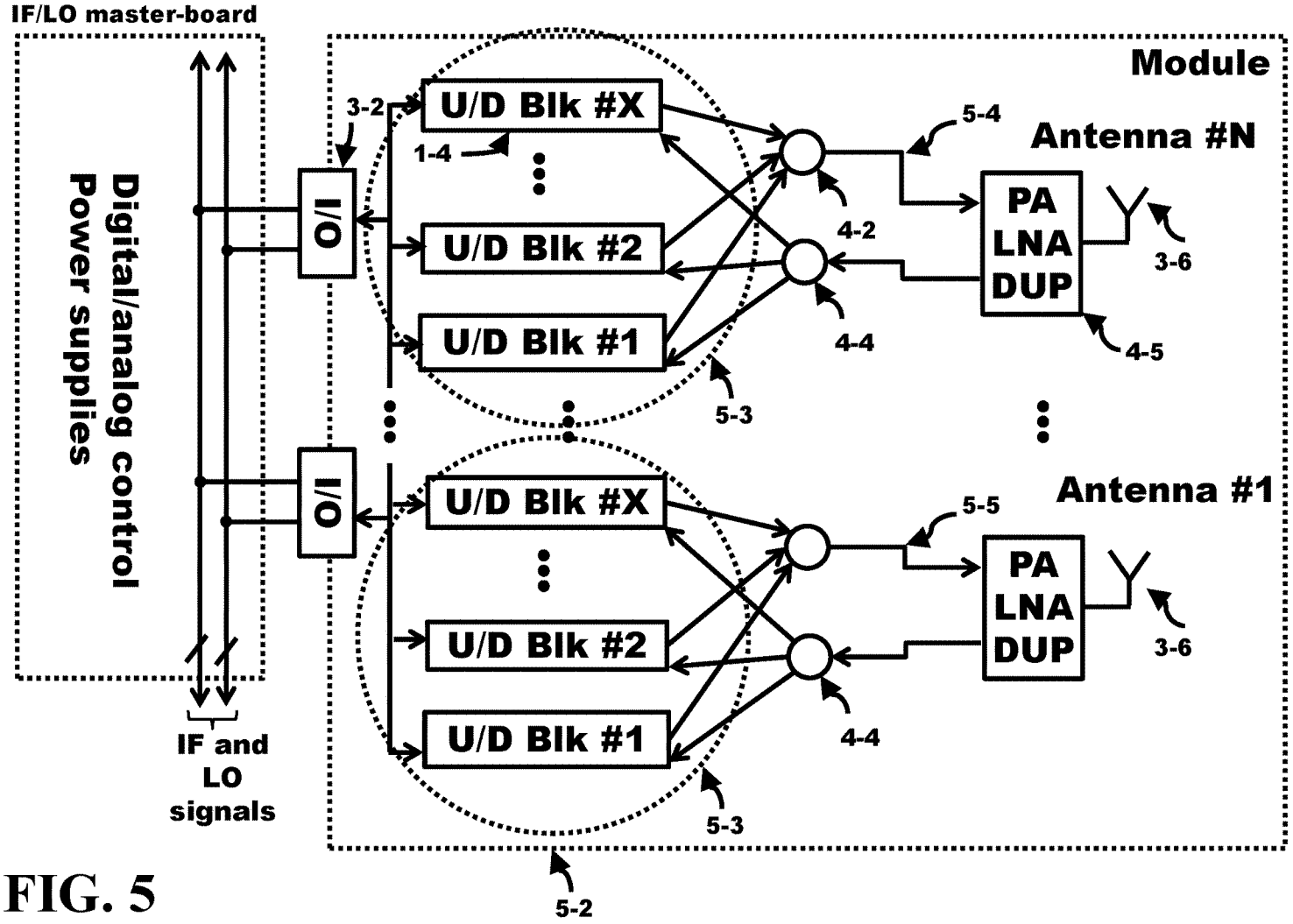
FIG. 5 illustrates an IF/LO master-board coupling LO and IF signals to a module through their I/O connectors the module up/down converters a plurality of IF's and uses cross connects to couple the U/D blocks to at least one antenna in accordance with the present disclosure.

FIG. 5 shows a module 5-2 populated with a plurality of antennas 3-6, a plurality of U/D blocks 1-4, and two I/O connectors 3-2. Another embodiment might use one connector that has twice as many leads for transferring electrical signals between the IF/LO master-board and the module. FIG. 5 combines a plurality of the modules in FIG. 4 into one module. The outgoing signal flow direction is formed in the direction from the IF/LO master-board to the module by transferring a plurality of IF signals and at least one LO signal from the IF/LO master-board through the I/O connectors to the module. The plurality of U/D blocks 1-4 on the module is partitioned into a plurality of bundled U/D blocks 5-3, one bundled U/D block 5-3 associated with each one of the plurality of antennas 3-6. Each individual U/D block 1-4 within the bundled U/D block 5-3 up-converts one of the plurality of IF signals by being mixed with the at least one LO signal into a corresponding outgoing RF signal. Each of the corresponding RF signals from a bundled U/D block is combined by the combiner 4-2 into a composite outgoing RF signal 5-4 wherein the second bundled U/D block generates a different composite outgoing RF signal 5-5. The composite outgoing RF signals from both bundled U/D blocks are coupled to the associated one of the plurality of antennas via block 4-5. The U/D block includes at least one mixer to up-convert each IF signal with an LO signal to generate an RF signal, at least one phase adjustment circuit controlled by an analog or digital signal to lead or lag the phase angle of at least one of the LO signal or the RF signal, and at least one amplitude adjustment circuit controlled by an analog or digital signal to modify the amplitude of at least one of the IF signal, the LO signal, or the RF signal.

Each of the plurality of U/D blocks on the module is partitioned into a plurality of bundled U/D blocks 5-3, one bundled U/D blocks 5-3 associated with each one of the antennas 3-6. The incoming signal flow direction follows the direction of a signal arriving from free space to the IF/LO master-board via the module. Each of the plurality of antennas receives and couples an incoming composite RF signal to a corresponding bundled U/D blocks via the distributor 4-4. Each down-converter within the U/D block 1-4 of the bundled down-converter includes at least one mixer to down-convert the incoming composite RF signal with an LO signal to generate an IF signal, at least one phase adjustment circuit controlled by an analog or digital signal to lead or lag the phase angle of the LO signal or the RF signal, and at least one amplitude adjustment circuit controlled by an analog or digital signal to modify the amplitude of at least one of the IF signal, the LO signal, or the RF signal. Each bundled down-converter mixes the incoming composite RF signal captured by its corresponding antenna with the LO signal to generate a plurality of IF signals. All incoming plurality of IF signals from all bundled down-converters are coupled from the module to the IF/LO master-board through one of the I/O connector 3-2.

A module with a plurality of antennas as present in FIG. 5 can have a plurality of up/down converters in one of the integrated circuits. Each of the traces from the connector to each up/down converter is carefully matched, while each of the traces from the up/down converter to their respective antenna on the module is also matched. All antennas receive a slightly different RF wireless signal from free space representing a particular communication channel simultaneously. The digital control signals are used to adjust each down-converted IF signal generated by the up/down Converter on the plurality of modules such that the IF signal generated from a received wireless signal from a particular point out in free space constructively enhances the other down-converted IF signals generated from received wireless signals arriving from that point.

Figure 6:
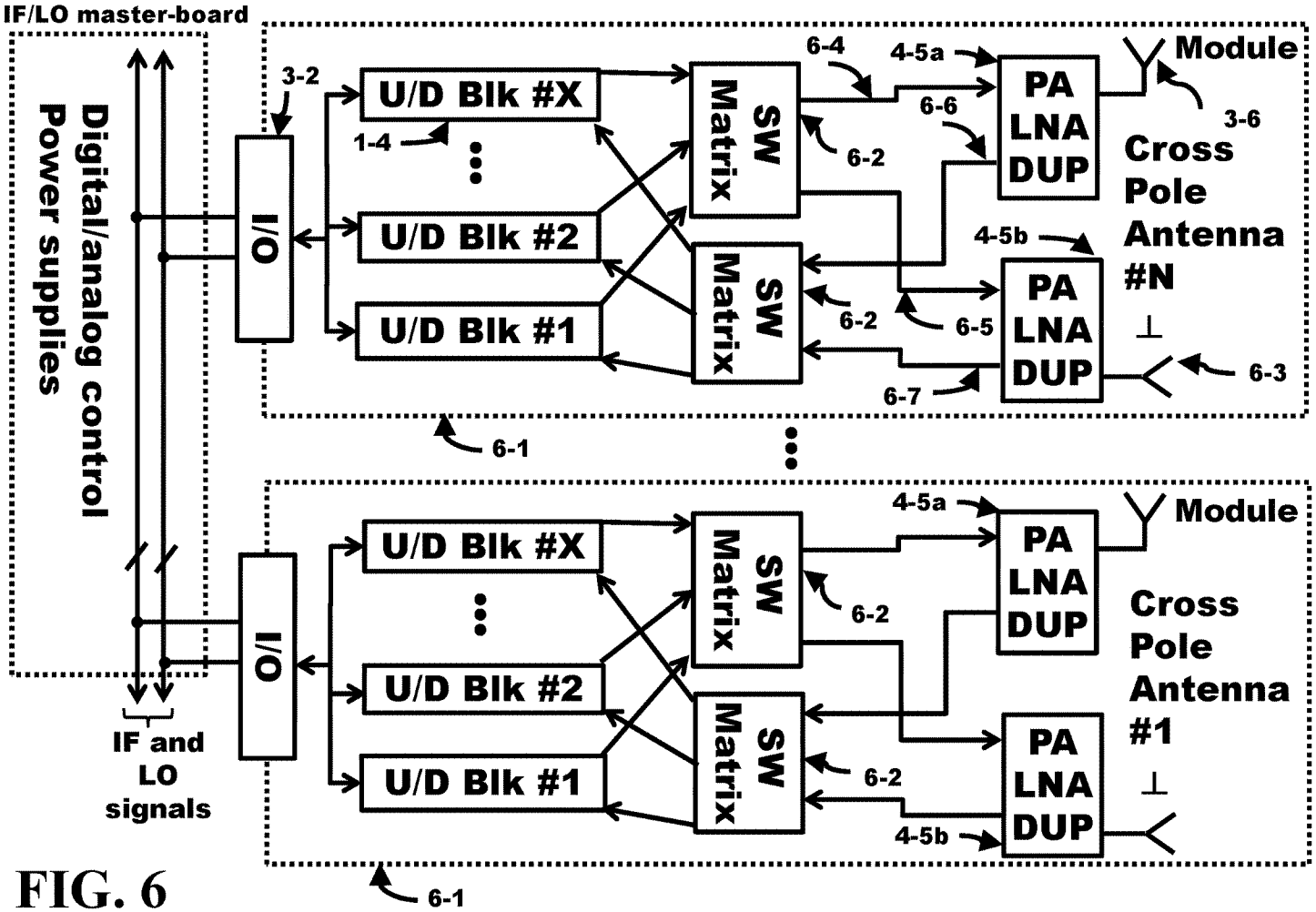
FIG. 6 depicts an IF/LO master-board coupling LO and IF signals to a plurality of modules through their I/O connector where each module up/down converters a plurality of IF's and uses switch matrixes to couple each of the U/D blocks to either a first antenna or another antenna orthogonal to the first antenna in accordance with the present disclosure.

FIG. 6 presents modules 6-1 populated with a first antenna 3-6, a second antenna 6-3 orientated orthogonal to the first antenna, at least one switch matrix 6-2, a plurality of U/D blocks 1-4, and an I/O connector 3-2. The I/O connector couples a plurality of IF signals and at least one LO signal from an IF/LO master-board to the module. Each of the plurality of IF signals are mixed with the LO signal in a corresponding up-converter within the U/D block 1-4. The outputs of the plurality of up-converters are coupled to a switch matrix 6-2. The switch matrix partitions the RF signals received from the up-converters into a first group 6-4 and the remainder of the RF signals into a second group 6-5. The first group 6-4 is amplified by the PA in block 4-5*a* and coupled to a first antenna 3-6. The second group 6-5 is amplified by the PA in a second block 4-5*b* and coupled to a second antenna 6-3. The switch matrix can also selectively place all up-converted RF signals into either the first group 6-4 or the second group 6-5. The first antenna 3-6 is orientated orthogonal to the second antenna 6-3. Together the two antennas form a cross-pole antenna. The U/D block includes at least one mixer to up-convert an IF signal with an LO signal to generate an RF signal, at least one phase adjustment circuit controlled by an analog or digital signal to lead or lag the signal, an amplitude adjustment circuit controlled by an analog or digital signal to modify the amplitude of at least one of the IF signal, the LO signal, or the RF signal.

In the incoming direction, the first antenna 3-6 receives and couples a first incoming composite RF signal 6-6 to the switch matrix 6-2, while the second antenna 6-3 receives and couples a second incoming composite RF signal 6-7 to the same switch matrix 6-2. The switch matrix couples and assigns either the first or second incoming composite RF signal to each of the plurality of down-converters within the U/D blocks 1-4. A control signal (not shown) is applied to the switch matric 6-2 to configure the assignment of the incoming composite RF signals to the down-converters within the U/D blocks 1-4. Each down-converter within each U/D block 1-4 includes at least one mixer to down-convert the incoming composite RF signal with an LO signal to generate an IF signal, at least one phase adjustment circuit controlled by an analog or digital signal to lead or lag the phase angle of at least one of the LO signal or the RF signal, and at least one amplitude adjustment circuit controlled by an analog or digital signal to modify the amplitude of at least one of the IF signal, the LO signal, or the RF signal. Each down-converter mixes the incoming composite RF signal captured by its corresponding antenna with the LO signal to generate a corresponding IF signal. All incoming plurality of IF signals from all down-converters are coupled from the module to the master-board through the I/O connector 3-2. Once the IF signal are on the IF/LO master-board, the corresponding IF signal from each of the modules are aggregated into a single IF signal that is sent to the DFE.

Figure 7:
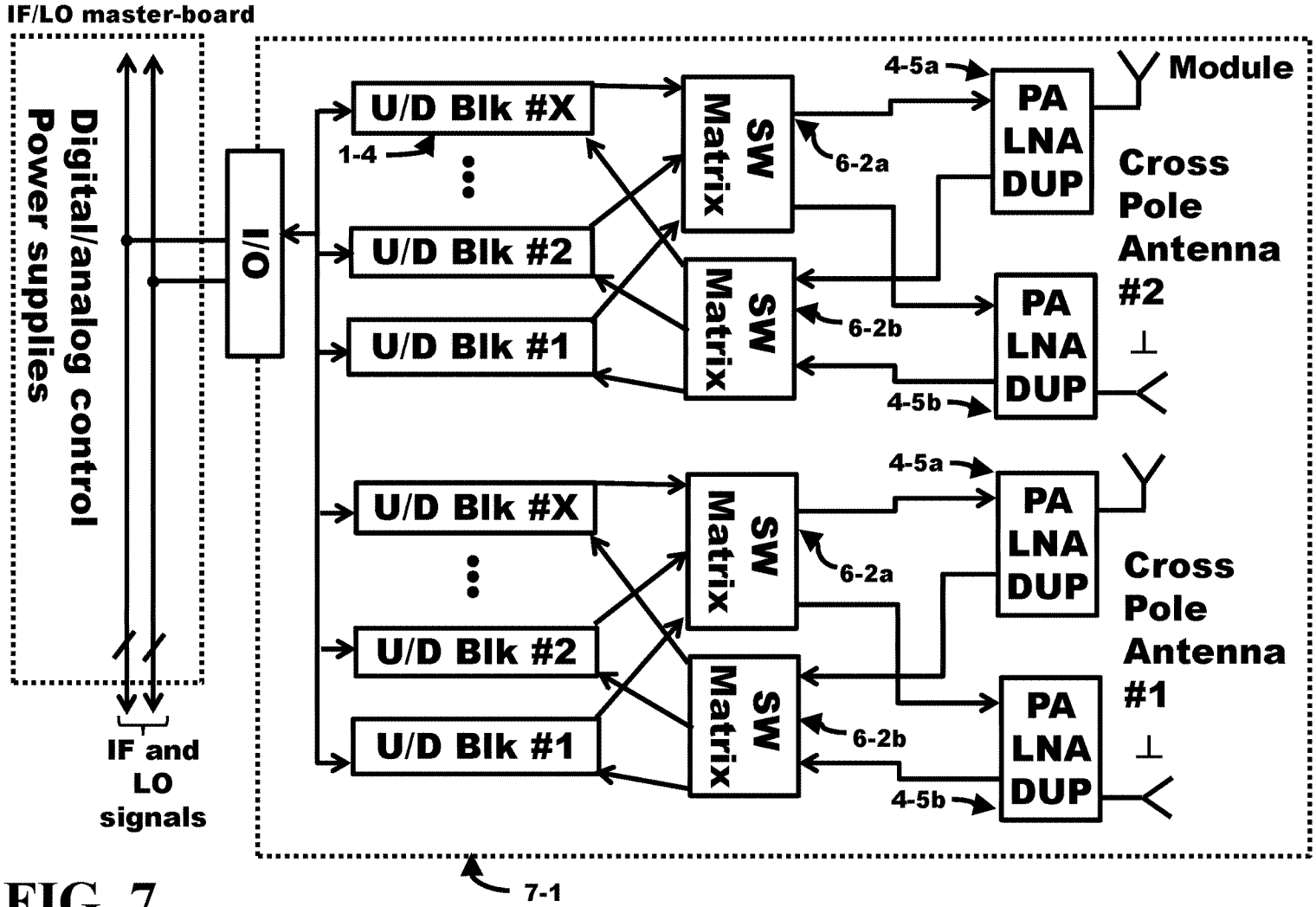
FIG. 7 depicts an IF/LO master-board coupling LO and IF signals to a single module through the I/O connector where the module up/down converters a plurality of IF's and uses switch matrixes to couple each of the U/D blocks to either a first antenna or another antenna orthogonal to the first antenna in accordance with the present disclosure.

FIG. 7 presents a module 7-1 populated with the contents of the two modules illustrated in FIG. 6. A later figure will present various views of this module illustrating the structure of the cross-pole antennas, the position of the cross-pole antennas on the module, and the shape of the circuit board of the module. Antenna 7-4 is positioned orthogonal to antenna 7-5 forming a first cross-pole antenna. Since the antennas are orthogonal to each other, they each can transmit electromagnetic energy at the same frequency simultaneously effectively doubling the available bandwidth of the system. Similarly, antenna 7-2 is positioned orthogonal to antenna 7-3 forming a second cross-pole antenna. Between the two cross-pole antennas, antenna 7-3 in the second cross-pole antenna can be orientated orthogonal to the antenna 7-4 of the first pole antenna.

Figure 8A:
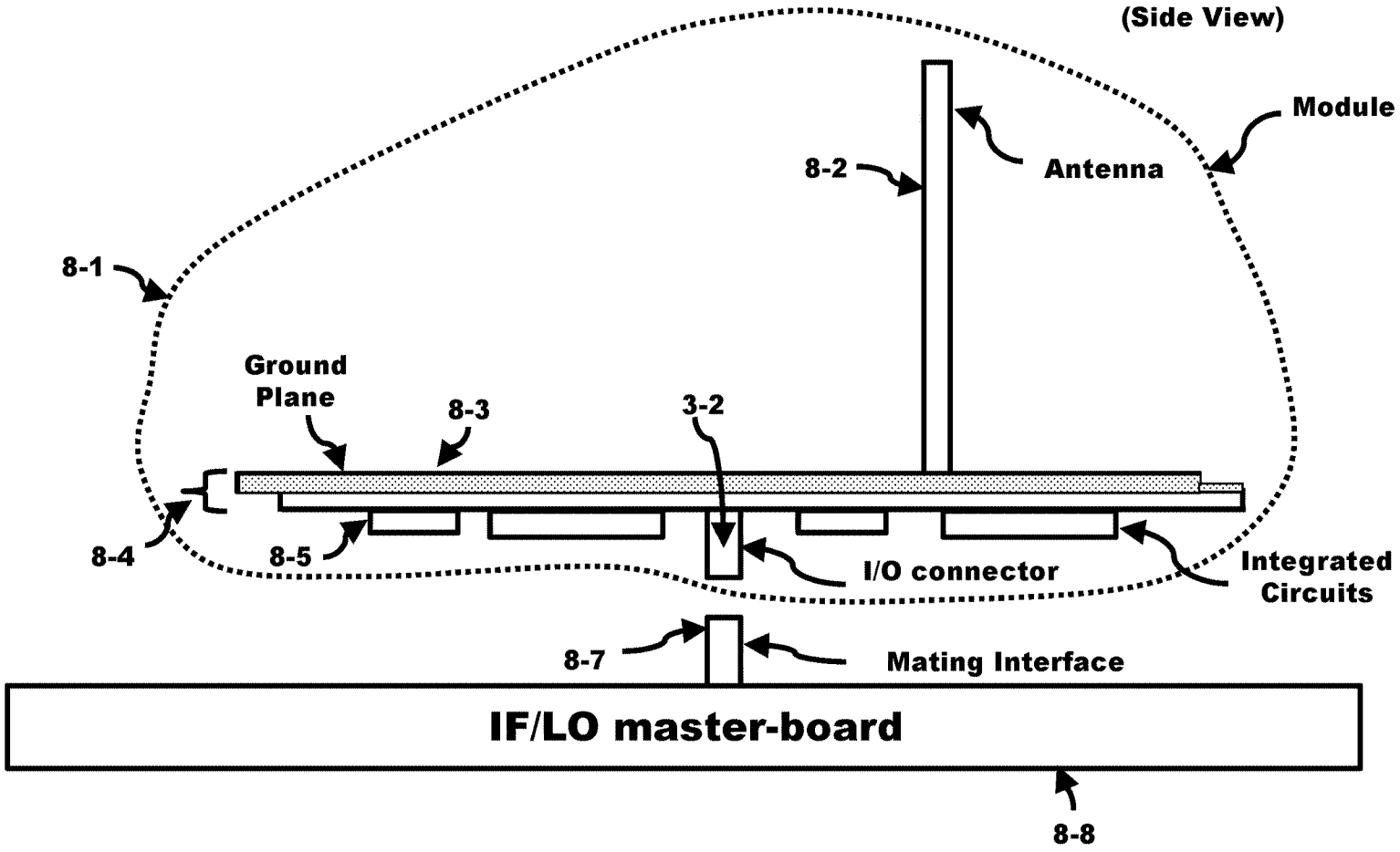
FIG. 8A shows a side view of a module comprising an antenna, ground plane, integrated circuits, and an I/O connector before being connected to the mating interface of an IF/LO master-board in accordance with the present disclosure.

FIG. 8A depicts a side view of an IF/LO master-board 8-8 and module 8-1 before module 8-1 is connected to master-board 8-1 by the I/O connector 3-2 and the mating interface 8-7. The module 8-1 includes a circuit board 8-4 with a planar metalized layer 8-3 on top surface of the circuit board. The planar metalized layer covers some or all portions of the surface, extends to all edges of the circuit board and covers at least some or all portions of the edges. The planar metalized layer forms a ground plane on the module. A circuit board 8-2 is mounted to the top surface of the ground plane and perpendicular to the ground plane. An antenna is located on this circuit board 8-2. The bottom surface of the module is populated with integrated circuits 8-5 and at least one I/O connector 3-2. The described electrical functionally of the module is implemented by integrated circuits. The integrated circuits can be a full custom design CMOS packaged device, an FPGA, or an ASIC. Discrete devices or components (capacitors, inductors, or resistors) can also be mounted on the circuit board. The IF/LO master-board 8-8 illustrates a mating interface 8-7 connected to the top surface of the board and into which connector 3-2 fits provide to connect the module—both electrically and physically—to the master-board.

Figure 8B:
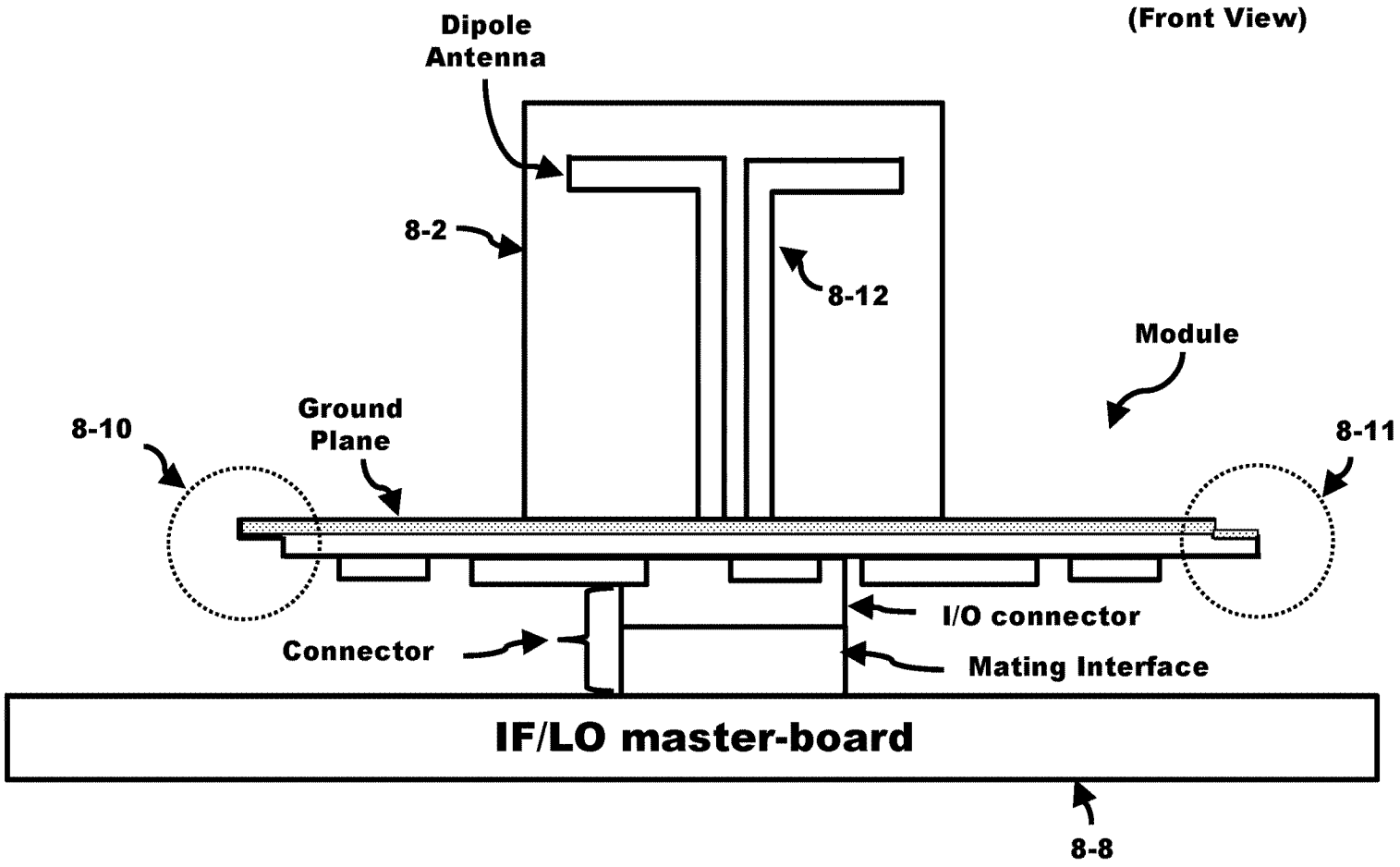
FIG. 8B presents a front view of a module comprising an antenna, ground plane, integrated circuits, and an I/O connector after being connected to the mating interface of the IF/LO master-board in accordance with the present disclosure.

FIG. 8B illustrates a front view of the module connected to the IF/LO master-board 8-8. The connection between these components is formed when the I/O connector is connected to the mating interface. This combination of these two components after being connected together may be referred to as a connector assembly. The connector assembly provides an electrical connection for signals transferred between the module and IF/LO master-board. The illustrated embodiment employs a connector made of a plurality of electrical leads to carry signals, each lead separated by an insulator. The physical aspect of the connector also provides mechanical support to the module with respect to the IF/LO master-board. In addition, the module can be easily separated or detached from the master-board by simply disconnecting the I/O connector from the mating interface. The front view shows the dipole antenna 8-12 patterned on the surface of the antenna's circuit board 8-2. Those in the art will understand that any suitable antenna, dipole, patch, microstrip, or otherwise, functioning to transmit or receive RF signals, now known or hereafter developed, may be used for such an antenna. The edges 8-10 and 8-11 of the module show the ground plane extending to the edges. This extension allows adjacent modules that are abutted to each other to electrically connect their ground plane together. The number of leads (conducting paths) within the I/O connector and the corresponding mating interface is sized to support the number of channels being transferred between the module and the IF/LO master-board.

Figure 9A:
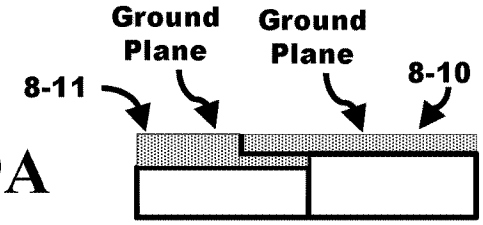
FIG. 9A shows an abutment between two modules with matching interfaces to provide a continuous ground plane in accordance with the present disclosure.
Figure 9B:
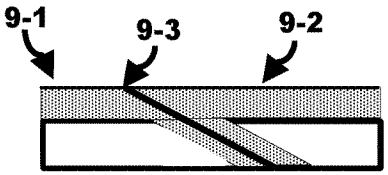
FIG. 9B illustrates an abutment between two modules with a slanted matching interface to provide a continuous ground plane in accordance with the present disclosure.

FIG. 9A illustrates how the edge 8-11 of one module abuts to the edge 8-10 of an adjacent module. The shaded regions indicate the metallization of each of the ground planes. Note that the metallization of the ground planes join together at the interface to provide electrical continuity of the ground plane between two connecting modules. Once the edges of the modules are abutted, the area of the ground plane of the individual modules combines such that the overall area of the ground plane of the modular phased array increases. This combined ground plane can be used by the plurality of antennas as their ground plane. FIG. 9B illustrates the edges of the modules having slanted metalized edges 9-1 and 9-2. The slanted edges abut at the interface 9-3 to connect the metallic surface of the modules together and increasing the area of the overall ground plane of the system.

Figure 9C:
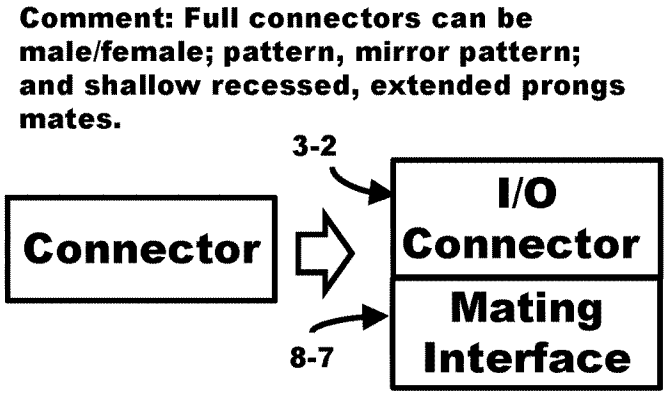
FIG. 9C depicts a connector comprising an I/O connecter connected to a mating interface in accordance with the present disclosure.

FIG. 9C presents a connector assembly formed by connecting the I/O connector 3-2 which is attached to the module to the mating interface 8-7 that is attached to the IF/LO master-board. The connector assembly provides electrical connections for signals transferred between the module and IF/LO master-board. The connector assembly also provides mechanical support to the module with respect to the IF/LO master-board. The I/O connector can be either a male connector or a female connector. The male and female connectors mate at an interface. After the male and female connectors are joined together, electrically conducting paths are formed through the connector. These electrically conducting paths carry electrical signals. In addition, the male and female connectors can be separated from each other at their interface to break the electrical connection between the module and the board and to detach the module from the IF/LO master-board. Once separated, the module can be tested and replaced with a replacement module if the original module was found to be defective. The illustrated embodiment employs a connector made of a plurality of electronic leads to carry signals where each lead is separated from another lead by an insulator. A variety of alternative connector assembly designs are available that would be suitable for alternative embodiments of the subject matter of the disclosure. Examples are printed circuit board (PCB) connectors, matched impedance connectors, and vertical surface mount connectors. Those skilled in the art will understand that any suitable connector assembly functioning to electrically connect, now known or hereafter developed, may be used to connect the module to the remainder of the system. The connector assembly carries IF signals, LO signals, digital control signals, power, and a ground reference.

Figure 10:
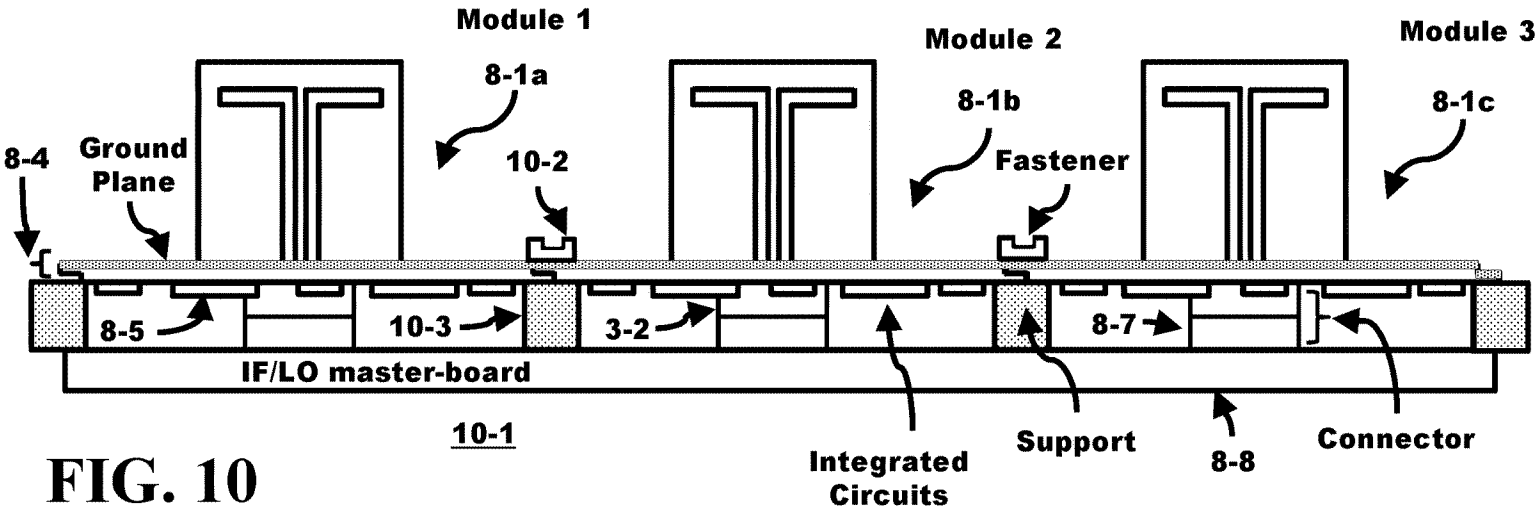
FIG. 10 illustrates a plurality of modules fastened to an IF/LO master-board forming a planar ground plane surface where fasteners and supports couple the ground planes of the modules together in accordance with the present disclosure.

FIG. 10 presents a cross sectional view of a sub antenna array 10-1 includes a plurality of modules 8-1*a* through 8-1-*c* connected to an IF/LO master-board 8-8. Each module further includes at least one antenna, integrated circuits 8-5, and at least one I/O connector 3-2. The IF/LO master-board is sized appropriately in length and width to place a plurality of mating interfaces 8-7 spaced apart accordingly to allow the placement of a corresponding number of a plurality of modules to be attached to the mating interfaces of the IF/LO master-board forming a sub antenna array. The I/O connector 3-2 attached to one of the modules is connected to one of the mating interfaces attached to the master-board forming a connector assembly. This connector assembly connects all electrical circuits between the IF/LO master-board and each corresponding connected module. The IF/LO master-board can then extend its distribution network to each of the plurality of attached modules. The distribution network in the IF/LO master-board distributes IF signals, LO signals, digital control signals, and power supplies, such as, power and ground to the modules via the connector assembly. By using a linear or planar corporate feed network, or by using a BDS network, all modules receive an identical signal from the distribution network that was routed on the master-board via the connector assembly. Furthermore, all connector assemblies have the same electrical characteristic which insures that either the IF or LO signal provided by the IF/LO master-board arrives on each of the modules in sync and in phase. Each of the modules connected via the connector assembly has substantially equal electrical traces; therefore, the wiring trace from the I/O connector to the up/down converter for each module is substantially identical. Therefore, one module receives equivalently the same IF signal and the same LO signal that all the remaining modules receive which are connected to the master-board via the connector.

Each of the plurality of modules is sized accordingly to allow the edges of the modules to abut one another when connected to the IF/LO master-board. A support 10-3 is placed on the IF/LO master-board to support the lower surface of the abutment formed between modules. A fastener 10-2 applies a force to the upper surface of the abutment of the module to firmly connect the edges of the module together. The supporting structure and fastener aids in the structural integrity and stability of the modular phased array and improves the connectivity between the ground planes of each abutted module. Those in the art will understand that any suitable fastener functioning to press one edge against another, now known or hereafter developed, may be used to connect the edges of the module together. The fastener can be a screw, adhesive, rivet, magnet, or snap.

The modules can be connected to the IF/LO master-board in one dimension to form a single column of a modular phased array as shown in FIG. 10. The modules can also be connected to the IF/LO master-board in two dimensions to form multiple columns and multiple rows of a modular phased array as will be shown. Each module uses control signals to shift the phase of the outgoing RF signal that has been generated on the module. The summation of all of the signals emitted from the phase array can combine constructively at a given location in-free space. Each module uses the control signals to shift the extraction of each of the plurality of the down-converted incoming IF signals from a composite incoming RF signal. The summation of all of these received IF signals can combine constructively to select the energy content of a communication channel from a given location in free space, while effectively cancelling the energy content of communication channels from different locations in free space.

FIG. 11A shows a top view of a module with two cross-pole antennas. The module is Z-shaped integrally formed tile that includes two rectangular portions, each supporting a single cross-pole antenna. As illustrated, the two rectangular portions are offset from each other so that the two cross-pole antennas are in different rows both horizontally and vertically. The top (facing) surface of the circuit board has a metalized layer that serves as a ground plane for the two cross pole antennas. The ground plane extends and covers at least a portion of the edges of the circuit board. The first cross-pole antenna includes the dipoles formed on the two circuit boards 11-2 and 11-3. A first dipole antenna is located on the circuit board 11-3, while the second dipole antenna orientated 90° to the first antenna and is located on the circuit board 11-2. Note that these two dipole antennas are effectively at the same location; however, they do not interfere with each other because the wireless signals are orthogonal to each other. The second cross-pole antenna includes the dipoles formed on the two circuit boards 11-5 and 11-6. A third dipole antenna is located on the circuit board 11-5, while a fourth dipole antenna orientated 90° to the third antenna is located on the circuit board 11-6.

A perspective view of the module with two cross-pole antennas is presented in FIG. 11B. The cross-pole antennas each comprising two dipole antennas that are orthogonal to each other is illustrated. The dipoles of the second cross-pole antenna are visible. The third dipole antenna includes the metallization layers 11-4 and 11-7 formed on the circuit board 11-5. The fourth orthogonal dipole antenna includes the metallization layers 11-8 and 11-9 formed on the circuit board 11-6. The dipoles presented in FIG. 11B are positioned farther from the ground plane as compared to the dipole presented in FIG. 8B and FIG. 10. As these dipoles were moved away from the ground plane, the metallization of the ground plane was extended onto the circuit boards 11-5 and 11-6. This extension caused the dipoles to attain a shape of a "C". Similarly, the first cross-pole antenna is located on the circuit boards of 11-2 and 11-3. In this case, however, these dipoles are located on the opposing side of the circuit board (dashed lines) are not directly visible from this perspective.

FIG. 11C presents a side view of the module with two cross-pole antennas. The dipole components 11-4 and 11-7 of a third dipole of the second cross-pole antenna are illustrated on the circuit board 11-5. The traces 11-12 and 11-14 are connected to DC ground via the vertical segments 11-11 and 11-13. These vertical segments are quarter wavelength long and offer a short at DC but provide a high impedance at the carrier frequency. The upper dipole elements 11-4 and 11-7 (effectively floating at the carrier frequency due to the high impedance) and are fed energy by the balun structure on the opposite side of the board (not shown) via the small gap between the two dipole elements. The power amp connects to the balun that is routed on the opposite side of the board 11-5. The power amp transfers the energy through the balun to a small gap between the dipole elements 11-4 and 11-7. This trace crosses over the small gap between the two dipole elements 11-4 and 11-7. Doing so, the portion of the metal of the balun that crosses over the small gap excites the (floating) dipole causing it to radiate the energy into free space. Those skilled in the art will understand that any suitable antenna functioning to emit or capture electromagnetic radiation, now known or hereafter developed, may be used to send or receive RF transmission signals. The antenna can be a patch antenna, a microstrip antenna, or a Vivaldi antenna, for example.

The fourth dipole in FIG. 11C is viewed edge-wise and not visible. The second dipole of the first cross-pole antenna is on the left side of the circuit board 11-2. The first dipole of the first cross-pole antenna is viewed edge-wise and not visible. The separation of the first cross-pole antenna from the second cross-pole antenna is half of the wavelength of the carrier frequency of the RF wireless signal. The bottom surface of the of the module's circuit board 8-4 is mounted with the I/O connector 3-2 and integrated circuits 8-5.

Figure 12:
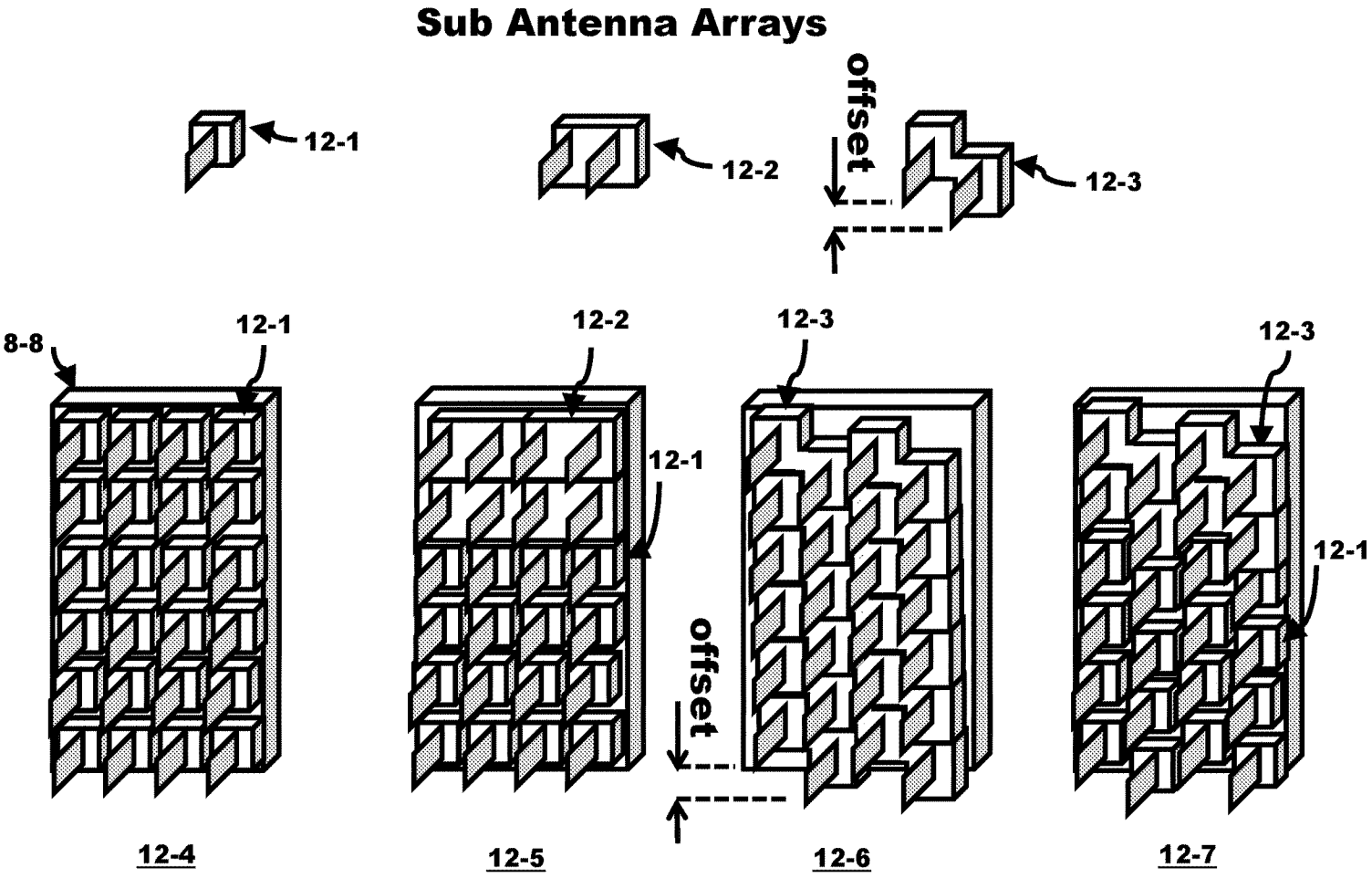
FIG. 12 shows a perspective view of individual modules (also referred to as tiles) with one or more antennas and the placement of these individual modules onto an IF/LO master-board forming different sub antenna arrays in accordance with the present disclosure.

FIG. 12 depicts how a module 12-1 with one antenna, a module 12-2 with two antennas and a module 12-3 with a first antenna offset from a second antenna can be connected to an IF/LO master-board to form sub antenna arrays. The modules can support one or more antennas. The IF/LO master-board 8-8 is a planar circuit board and has a sufficient width and a length dimensions to support the connection of a plurality of modules. The I/O connector of each module connects to one of the mating interfaces of the IF/LO master-board and provides physical support and electrical continuity between the IF/LO master-board and each of the modules. Each of the plurality of modules is arranged to form a planar 2-D structure following the planar structure (of width and length) of the IF/LO master-board. The antennas mounted on each of the modules extend the planar 2-D structure of the IF/LO master-board to form a planar antenna phased array formed from the plurality of modules. The ground plane of each module is connected to the ground plane of each adjacent module forming a ground plane that extends to approximately the size of the IF/LO master-board.

The module 12-1 with a single antenna is attached to an IF/LO master-board 8-8 to form a 4×6 sub antenna array 12-4. This sub antenna array positions the antennas of the modules 12-1 into horizontal rows and vertical columns. The separation of the antennas from one another is related to the wavelength of the carrier frequency of the wireless signal being transmitted or received from/by the antenna array. The antenna separation in a modular phased array is ½ the wavelength of the carrier frequency.

The sub antenna array 12-5 presents the same antenna pattern as presented in 12-4, but the sub antenna array 12-5 uses two different types of modules. Single antenna modules 12-1 are connected to the lower half of the IF/LO master-board 8-8 while the module 12-2, which has two antennas, is connected to the upper half. Preferably, sub antenna arrays constructed from identical modules are preferred to reduce cost issues and maintain uniformity, but as shown in 12-5, other methods of constructing the modular phased array using different modules are possible.

FIG. 12 illustrates a sub antenna array 12-6 constructed from a Z-shaped module 12-3 which has two cross-pole antennas that are offset from one another. The antennas within each vertical column of array 12-6 are arranged equally separated from one another. The separation between the center of the antennas within a column in the vertical direction is a ½ wavelength of the carrier frequency. The antennas within every "even" numbered column form horizontal rows that are spaced a wavelength apart from one another. The antennas within every "odd" numbered column form horizontal rows that are spaced a wavelength apart from one another. The vertical spacing between two adjacent rows is approximately a ¼ wavelength of the carrier frequency of the RF signal due to the offset in the module 12-3. The sub antenna array is constructed with this offset to improve the RF performance of the antenna.

The last sub antenna array 12-7 depicts the same offset antenna structure as presented in 12-6. The difference is that the upper portion of the array is constructed using the offset modules 12-3 while the lower half of the array is constructed from the single rectangular, antenna modules 12-1. Depending on the desired coverage that a modular phased array needs to provide in communication system, the antenna array used in the system can be formed using one or more sub antenna arrays where each of the sub antenna arrays includes a plurality of modules.

Figure 13A:
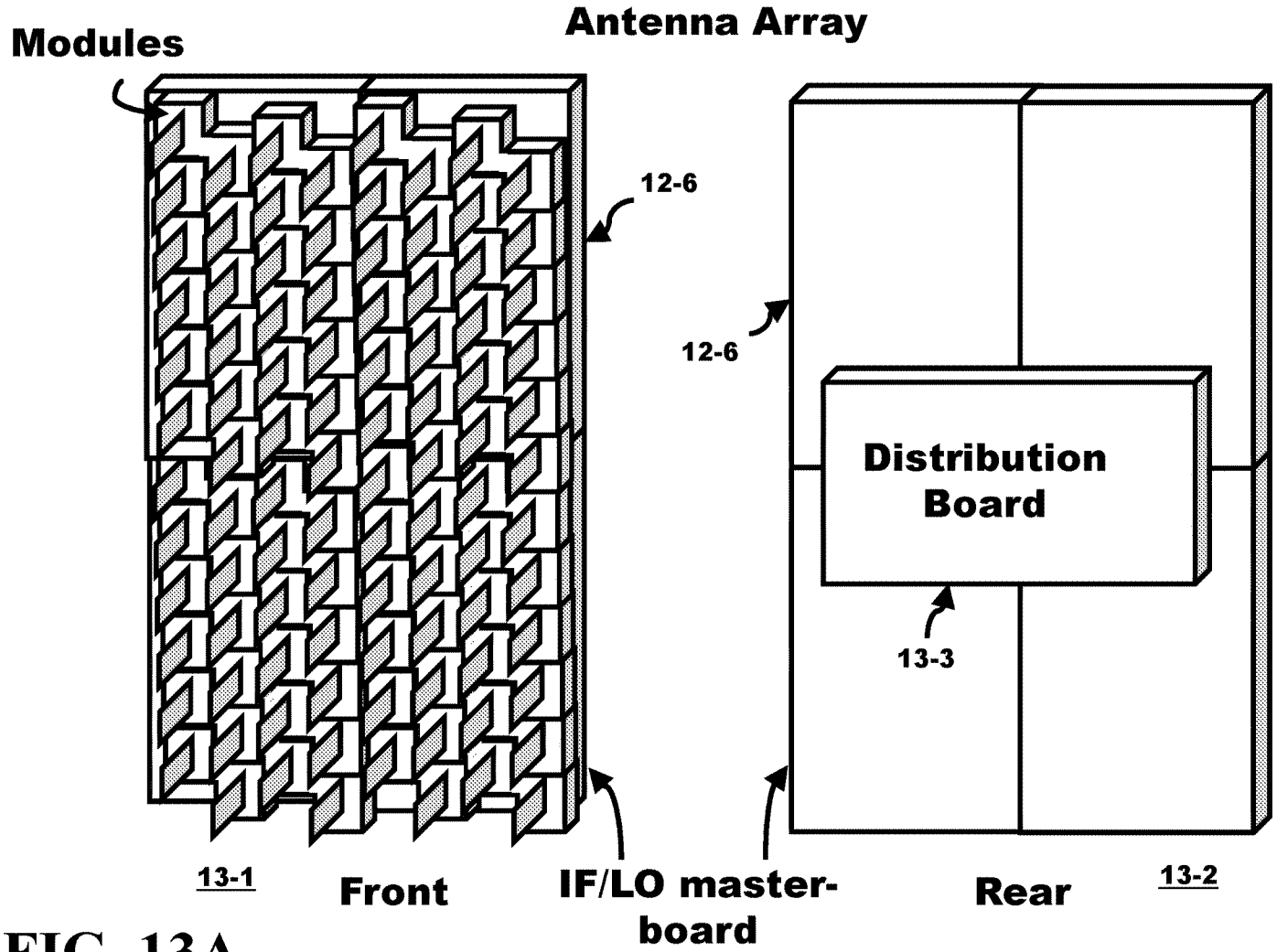
FIG. 13A illustrates a perspective view of the front and rear modular phased array formed with four sub arrays each populated with modules each comprising two antennas and a distribution board coupling all four sub arrays together in accordance with the present disclosure.

FIG. 13A shows a modular phased array 13-1 constructed from four sub antenna arrays 12-6. The adjacent antenna columns are offset from each other. Each module contains two dipole antennas that are offset from each other by a ¼ wavelength. The dipole antenna can be substituted with the cross-pole antenna to create an antenna array that can transmit RF signals with a vertical polarization, a horizontal polarization, or a combination of the two polarizations. The rear 13-2 of the modular phased array illustrates the distribution board 13-3 coupling to each of the sub antenna arrays 12-6. The distribution board transfers the IF signals, one or more LO signals, digital/analog control signals, power and ground between the digital front end (DFE) to the sub antenna array sections. Each sub antenna array distributes these IF signals, one or more LO signals, digital/analog control signals, power and ground to their respectively attached modules.

Figure 13B:
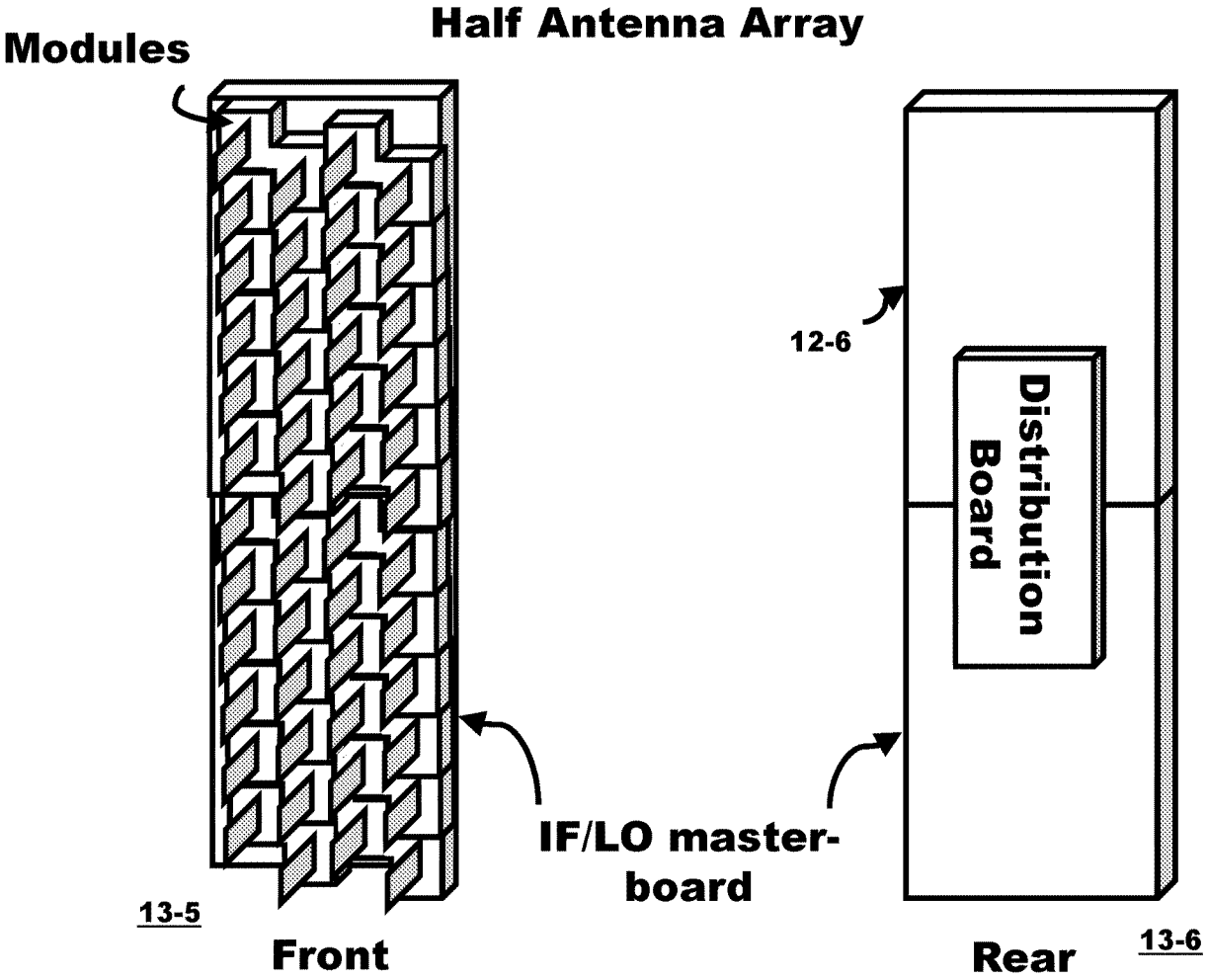
FIG. 13B illustrates a perspective view of the front and rear modular phased array formed with two sub arrays each populated with modules comprising two antennas and a distribution board coupling all two sub arrays together in accordance with the present disclosure.

A narrower version of the antenna array 13-5 is depicted in FIG. 13B where only two sub antenna arrays are used. This modular phased array will provide less selectivity in the horizontal direction. A rear view 13-6 depicts the distribution board coupling the two sub antenna array together to form the narrower antenna array.

Figure 14:
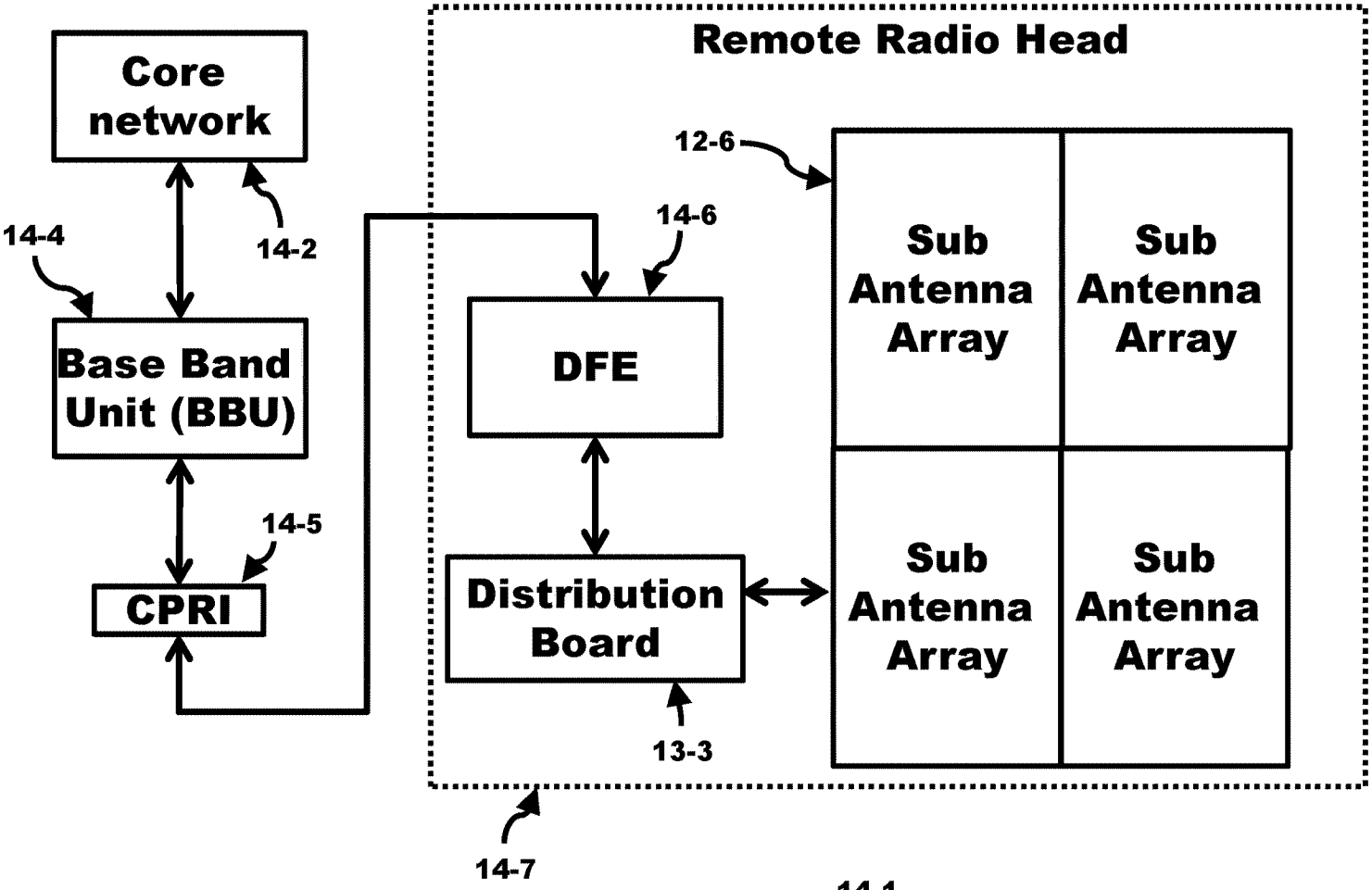
FIG. 14 illustrates a block diagram of a base station utilizing an active antenna system in accordance with the present disclosure.

FIG. 14 depicts a base station coupled to the core network 14-2. An eNodeB includes a baseband unit (BBU) 14-4 and at least one remote radio head (RRH) 14-7. An optical interface compliant with a common public radio interface (CPRI) 14-5 specification couples the BBU 14-4 to the RRH 14-7. The common public radio interface (CPRI) 14-5 is designed to conform to the standards as defined by the specifications for the 4GPP long-term evolution (LTE). The BBU is responsible for digital signal processing, termination of lines to the core network and to neighboring eNodeB's, monitoring, and call processing. The BBU interacts with data packets received from and transmitted to the core network 14-2. The RRH 14-7 includes a plurality of sub antenna arrays 12-6. The RRH converts digital baseband signals received from the BBU into radio frequency signals that are transmitted from the antennas. The RRH converts radio frequency signals from the antennas into digital baseband signals that are transmitted to the BBU.

Signal conversion to/from baseband from/to radio frequency is done in two steps. First, signal conversion to/from baseband from/to an intermediate frequency (IF) is done in the Digital Front-End (DFE) block 14-6. Second, signal conversion to/from IF from/to radio frequency is done in the Modules of the sub antenna arrays 12-6. The DFE generates the LO signal necessary for up/down conversion in the sub antenna arrays.

The distribution block 13-3 is mounted to each of the plurality of sub antenna block and distributes the LO signal and outgoing IF signals received from the digital front end (DFE) 14-6 to all sub antenna arrays. These IF signal is up-converted and transmitted by the antenna array. The distribution block also receives the incoming IF signals after they were down-converted from the received RF signal and sends them to the DFE 14-6. The BBU performs the computation for the system.

Other embodiments are within the following claims. For example, a network and a portable system can exchange information wirelessly by using communication techniques such as Time Division Multiple Access (TDMA), Frequency Division Multiple Access (FDMA), Code Division Multiple Access (CDMA), Orthogonal Frequency Division Multiplexing (OFDM), Ultra Wide Band (UWB), Wi-Fi, WiGig, Bluetooth, etc. The communication network can include the phone network, IP (Internet protocol) network, Local Area Network (LAN), ad hoc networks, local routers and even other portable systems. A "computer" can be a single machine or processor or multiple interacting machines or processors (located at a single location or at multiple locations remote from one another).

What is claimed is:

1. A removable module for a phased array, said removable module comprising:

a circuit board having a planar ground plane and circuitry laid out on a back surface of the circuit board, said circuitry comprising an RF (radio frequency) front end circuit for performing up or down frequency conversion;

an antenna mounted on and extending away from a front side of the circuit board said RF front end circuit coupled to the antenna;

a group of one or more first connectors mounted directly on and extending away from the back surface of the circuit board, said group of one or more first connectors for physically and electrically connecting the removable module to a master board through a corresponding group of one or more mating interface connectors on the master board as a consequence of placing the removable module onto the master board and for physically and electrically disconnecting the removable module from the master board as a consequence of pulling the removable module away from the master board, said group of one or more first connectors on the removable module having a plurality of electrically conductive lines for carrying an externally supplied LO (local oscillator) signal for the RF front end circuit on the removable module and for carrying an IF (intermediate frequency) signal to or from the RF front end circuit on the removable module.

2. The removable module of claim 1, wherein the RF front end circuit comprises an up converter for mixing the IF signal and a signal derived from the LO signal to generate an RF signal that is delivered to the antenna.

3. The removable module of claim 1, wherein the RF front end circuit comprises a down converter for mixing an RF signal received by the antenna with a signal derived from the LO signal to generate a received IF signal that is delivered to external circuitry through the one or more first connectors.

4. The removable module of claim 1, wherein the one or more first connectors is a single connector.

5. The removable module of claim 1, wherein the one or more first connectors is a plurality of first connectors.

6. The removable module of claim 1, wherein the ground plane is located on the front side of the circuit board.

7. The removable module of claim 1, wherein the RF front end circuit includes phase control circuitry for adjusting the phase of the RF signal that is generated by the RF front end circuit.

8. The removable module of claim 1, wherein said plurality of electrically conductive lines of the one or more first connectors are also for carrying externally supplied control signals for controlling the RF front end circuit.

9. The removable module of claim 1, wherein said plurality of electrically conductive lines of the one or more first connectors are also for supplying power to the RF front end circuit from an external source.

10. The removable module of claim 1, further comprising a plurality of antennas each of which is mounted on and extends away from the front side of the circuit board, wherein said first-mentioned antenna is one of said plurality of antennas.

11. The removable module of claim 10, wherein said circuitry further comprises a plurality of RF front end circuits each of which is coupled to a different one of the plurality of antennas, wherein said first-mentioned RF front end circuit is one of said plurality of RF front end circuits.

12. The removable module of claim 11, wherein the plurality of electrically conductive lines of the group of one or more first connectors are for carrying an externally supplied LO signal for each of the plurality of RF front end circuits on the removable module and for carrying an IF signal for or from each of the plurality of RF front end circuits on the removable module.

13. The removable module of claim 1, wherein the group of one or more first connectors on the removable module are also for providing mechanical support of the removable module on the master board when connected to the corresponding group of one or more mating interface connectors on the master board.

14. A phased array comprising:

a planar master board having a first network of signal transmission lines for distributing LO (local oscillator) signals;

a plurality of groups of one or more first connectors, said plurality of groups of one or more first connectors mounted on and extending away from a top side of the master board, wherein each group of one or more first connectors is coupled to the first network of transmission lines; and a plurality of identically-shaped, removable modules mounted on the master board, each of which comprises:

a circuit board having a ground plane and circuitry laid out on a back surface of the circuit board, said circuitry comprising an RF (radio frequency) front end circuit for performing up or down frequency conversion;

an antenna mounted on and extending away from a front side of the circuit board said RF front end circuit coupled to the antenna on that removable module;

and a group of one or more mating interface connectors mounted directly on the back surface of and extending away from the circuit board, said one or more mating interface connectors plugged into a corresponding group of one or more first connectors on the master board for physically and electrically connecting that removable module to the master board as a consequence of placing that removable module onto the master board and for physically and electrically disconnecting that removable module from the master board as a consequence of pulling that removable module away from the master board, said group of one or more mating interface connectors on that removable module having a plurality of electrically conductive lines for carrying an externally supplied LO signal from the master board for the RF front end circuit on that removable module and for carrying an IF (intermediate frequency) signal to or from the RF front end circuit on that removable module, wherein the circuit boards of the plurality of removable modules lie in a common plane and form a planar structure that is spaced apart from the planar master board.

15. The phased array of claim 14, wherein on each removable module of the plurality of removable modules the RF front end circuit of that removable module comprises an up converter for mixing the IF signal and a signal derived from the LO signal to generate an RF signal that is delivered to the antenna.

16. The phased array of claim 14, wherein on each removable module of the plurality of removable modules the RF front end circuit of that removable module comprises a down converter for mixing an RF signal received by the antenna on that removable module with a signal derived from the LO signal to generate a received IF signal that is delivered to external circuitry through the one or more first connectors on that removable module.

17. The phased array of claim 14, wherein on each removable module of the plurality of removable modules the one or more first connectors on that removable module is a single connector.

18. The phased array of claim 14, wherein on each removable module of the plurality of removable modules the one or more first connectors on that module is a plurality of first connectors.

19. The phased array of claim 14, wherein on each removable module of the plurality of removable modules the ground plane is located on the front side of the circuit board of that removable module.

20. The phased array of claim 14, wherein on each removable module of the plurality of removable modules the RF front end circuit on that removable module includes phase control circuitry for adjusting the phase of the RF signal that is generated by the RF front end circuit on that removable module.

21. The phased array of claim 14, wherein on each removable module of the plurality of removable modules said plurality of electrically conductive lines of the one or more first connectors on that removable module are also for carrying externally supplied control signals for controlling the RF front end circuit on that removable module.

22. The phased array of claim 14, wherein on each removable module of the plurality of removable modules said plurality of electrically conductive lines of the one or more first connectors on that removable module are also for supplying power from an external source to the RF front end circuit on that removable module.

23. The removable module of claim 14, wherein in each removable module of the plurality of removable modules, the group of one or more first connectors on that removable module is also for providing mechanical support of that removable module on the master board when connected to the corresponding group of one or more mating interface connectors on the master board.

* * * * *